US011384477B2

(12) United States Patent
Leung et al.

(10) Patent No.: US 11,384,477 B2
(45) Date of Patent: Jul. 12, 2022

(54) GARMENT STEAMER SYSTEM WITH MULTI-FUNCTION AIR AND STEAM CHAMBER

(71) Applicant: CONAIR CORPORATION, Stamford, CT (US)

(72) Inventors: Anthony Kit Lun Leung, North Point (HK); Kin Man Lai, New Territories (HK)

(73) Assignee: Conair LLC, Stamford, CT (US)

( * ) Notice: Subject to any disclaimer, the term of this patent is extended or adjusted under 35 U.S.C. 154(b) by 153 days.

(21) Appl. No.: 16/993,550

(22) Filed: Aug. 14, 2020

(65) Prior Publication Data

US 2022/0049415 A1 Feb. 17, 2022

(51) Int. Cl.
*D06F 73/02* (2006.01)
*D06F 58/10* (2006.01)

(52) U.S. Cl.
CPC ..... *D06F 73/02* (2013.01); *D06F 58/10* (2013.01)

(58) Field of Classification Search
CPC ..... D06F 73/02; D06F 58/10
See application file for complete search history.

(56) References Cited

U.S. PATENT DOCUMENTS 2,515,828 A * 7/1950 Jarmain ..... D06F 73/00 34/106
2,788,162 A 4/1957 Hitz
2,969,897 A * 1/1961 Paris ..... D06F 71/34 223/51
4,475,673 A * 10/1984 Ochiai ..... D06F 73/00 38/144
4,493,160 A 1/1985 Brembilla et al.
5,555,648 A 9/1996 Griffin
5,730,006 A * 3/1998 Conley ..... A47G 25/54 223/51
6,189,346 B1 * 2/2001 Chen ..... D06F 73/02 68/5 R
6,622,529 B1 * 9/2003 Crane ..... D06F 73/02 8/149.2

(Continued)

OTHER PUBLICATIONS

Corresponding PCT Application No. PCT/US2021/041724 International Search Report and Written Opinion dated Oct. 21, 2021.

*Primary Examiner* — Benjamin L Osterhout
(74) *Attorney, Agent, or Firm* — Grogan, Tuccillo & Vanderleeden LLP

(57) ABSTRACT

A garment treatment device includes a base, a water reservoir received on the base, a steam generator housed in the base and in fluid communication with the water reservoir, an air delivery system housed in the base, a pole extending from the base, and a garment bag having an interior space sized to receive a garment, the garment bag being receivable on the pole. The air delivery system is configured to provide air to the interior space to dry the garment in a drying mode of operation, and to inflate the garment bag so that an exterior, front face of the garment bag forms a cushioned support surface for supporting the garment on the exterior, front face in an ironing mode of operation. The steam generator is configured to convert water from the water reservoir into steam for passage into the garment bag in a steaming mode of operation.

20 Claims, 27 Drawing Sheets

(56) References Cited

U.S. PATENT DOCUMENTS

| | | | | |
|---|---|---|---|---|
| 7,121,024 | B1 * | 10/2006 | Clevenberg | D06F 71/32 38/25 |
| 7,464,840 | B1 * | 12/2008 | Park | D06F 71/36 223/74 |
| 7,475,504 | B2 | 1/2009 | Leung | |
| 8,950,031 | B1 * | 2/2015 | Jaramillo | D06F 87/00 68/5 R |
| 9,157,180 | B2 | 10/2015 | Hu | |
| 10,508,383 | B2 | 12/2019 | Nagai et al. | |
| 2002/0053607 | A1 * | 5/2002 | Gaaloul | B05B 17/0615 239/302 |
| 2002/0079329 | A1 * | 6/2002 | Verherbrugghen | A47K 5/12 222/143 |
| 2002/0154011 | A1 * | 10/2002 | Pasin | D06F 73/02 340/635 |
| 2003/0126691 | A1 * | 7/2003 | Gerlach | D06F 58/10 8/158 |
| 2004/0163184 | A1 * | 8/2004 | Waldron | D06F 73/02 68/5 R |
| 2004/0211227 | A1 * | 10/2004 | Jackson | D06F 58/203 34/621 |
| 2005/0120757 | A1 * | 6/2005 | Jackson | D06F 73/02 68/5 R |
| 2009/0119955 | A1 * | 5/2009 | Hong | D06F 58/10 38/14 |
| 2014/0082978 | A1 * | 3/2014 | Hu | D06F 73/00 38/2 |
| 2015/0204007 | A1 | 7/2015 | Lim et al. | |
| 2017/0089003 | A1 * | 3/2017 | Chua | F22B 1/284 |
| 2019/0301072 | A1 * | 10/2019 | Hoppe | D06F 87/00 |

* cited by examiner

GARMENT STEAMER SYSTEM WITH MULTI-FUNCTION AIR AND STEAM CHAMBER

FIELD OF THE INVENTION

The present invention relates generally to devices for the care and treatment of garments and other fabric items and, more particularly, to a multifunction garment steaming system and apparatus.

BACKGROUND OF THE INVENTION

Steam generating devices for applying steam are particularly useful in removing wrinkles and improving the appearance of hanging garments, draperies, upholstery, and other items made of fabric. A garment steamer that has a boiler in a reservoir of water, a hand-held wand, and flexible tubing providing a pathway for steam generated by the boiler from the reservoir to a hand-held wand is known. Such appliances have been used to steam the wrinkles out of garments, cloth, fabric, and the like. In operation, an immersion-type resistance heater in the reservoir of water, or other type of steam generator, heats the water to a boil to produce steam. The steam is guided to the hand-held wand via the flexible tubing and is ejected from the wand to remove wrinkles from fabric. One such known device is disclosed in U.S. Pat. No. 6,886,373, the entire contents of which are incorporated by reference herein.

While existing garment steaming devices are generally suitable for what may be regarded as ordinary performance, there is room for improvement with respect to the functions that such devices can perform.

In view of the above, there is a need for a multifunction garment treatment system that improves upon the devices currently known in the art.

SUMMARY OF THE INVENTION

It is an object of the present invention to provide a garment treatment system or apparatus.

It is another object of the present invention to provide a garment treatment system or apparatus that allows multiple treatment functions to be carried out using the system.

It is another object of the present invention to provide a garment treatment system or apparatus that provides for steam refreshing of garments or fabric times.

It is another object of the present invention to provide a garment treatment system or apparatus that provides for air drying of garments or fabric times.

It is another object of the present invention to provide a garment treatment system or apparatus that provides for ironing of garments or fabric items.

These and other objects are achieved by the present invention.

According to an embodiment of the invention, a garment treatment device includes a flexible garment bag having an interior space sized to receive a garment, and an air delivery system configured to provide air to the interior space to dry the garment in a drying mode of operation, and to inflate the garment bag so that an exterior, front face of the garment bag forms a cushioned support surface for supporting the garment in an ironing mode of operation.

According to another embodiment of the invention, a garment treatment device includes a base, a water reservoir received on the base, a steam generator housed in the base and in fluid communication with the water reservoir, an air delivery system housed in the base, a pole extending from the base, and a garment bag having an interior space sized to receive a garment, the garment bag being receivable on the pole. The air delivery system is configured to provide air to the interior space to dry the garment in a drying mode of operation, and to inflate the garment bag so that an exterior, front face of the garment bag forms a cushioned support surface for supporting the garment on the exterior, front face in an ironing mode of operation. The steam generator is configured to convert water from the water reservoir into steam for passage into the garment bag in a steaming mode of operation.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
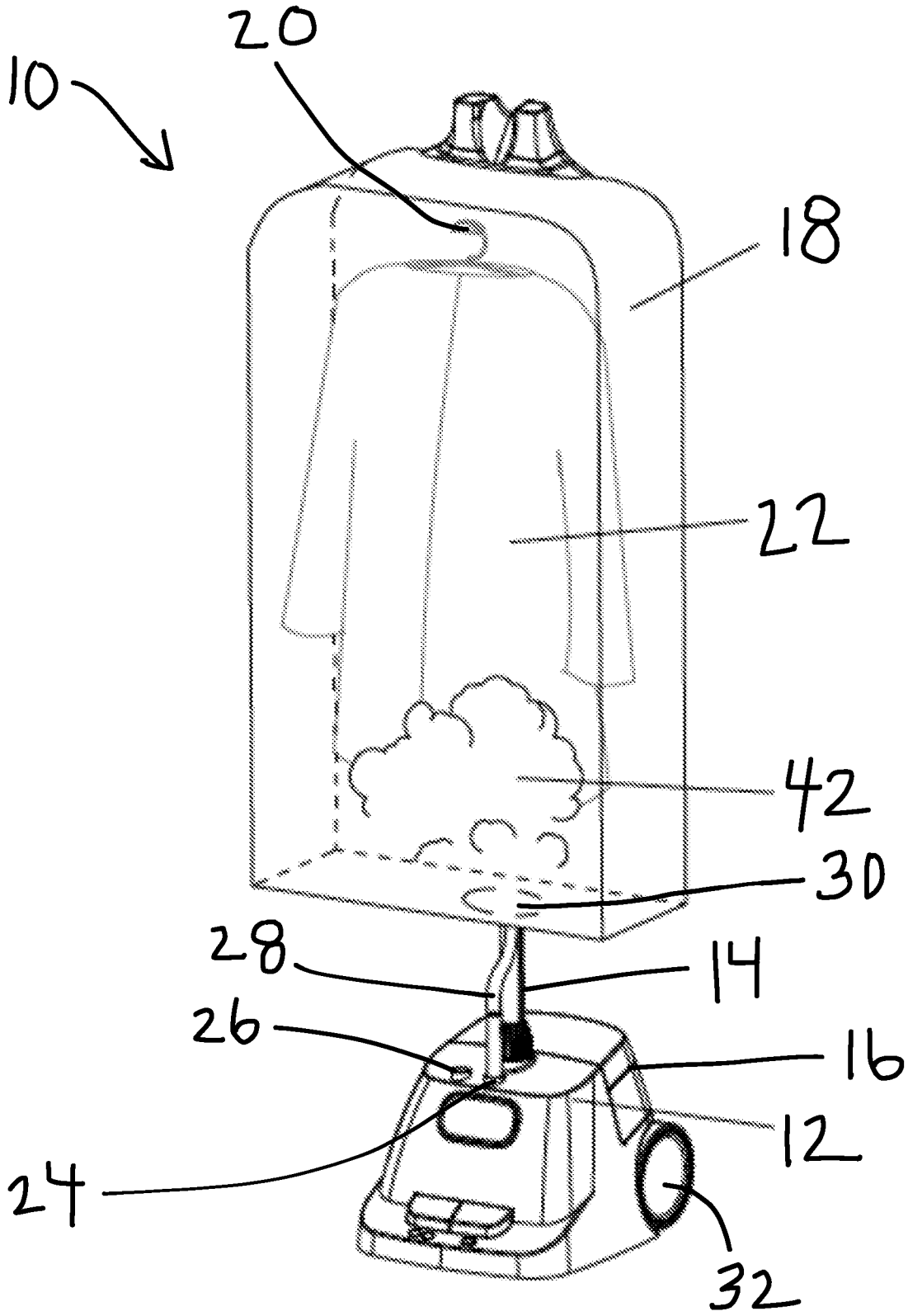
FIG. 1 is a front, perspective view of a garment steaming device according to an embodiment of the present invention.

Referring to FIGS. 1-3, 24 and 30, a garment treatment device 10 (also referred to herein as garment treatment system 10 or garment treatment apparatus 10) according to an embodiment of the present invention is illustrated. The garment treatment device 10 includes a base 12 and a telescopic pole 14 extending vertically upward from the base 12. Similar to existing, prior art devices such as that disclosed in U.S. Pat. No. 6,886,373, the base 12 includes a fluid or water tank/reservoir 16, a pump (not shown) connected to the water tank 16 through tubing, and a steam generator (not illustrated in FIGS. 1 and 2) which is coupled to the pump through tubing. The steam generator may include any suitable heating, boiler or coil arrangement to convert a fluid, e.g., water, delivered from the water tank 16 to steam. The pump may be any suitable pump to deliver water to the steam generator such as a peristaltic pump, and axial pump, a centrifugal pump or the like. In one embodiment, the pump is a peristaltic pump. In an embodiment, the base 12 may have a plurality of wheels 32 or casters facilitating movement of device 10 along a surface.

The garment treatment device 10 further includes a garment bag 18 removably receivable on the distal end of the telescopic pole 14, into which a hook 20 or hanger of the telescopic pole 14 extends for hanging of a garment 22 or other fabric item from the pole 14 using a clothes hanger or the like. In an embodiment, the garment bag 18 is formed from a flexible or semi-flexible material such as polymer, plastic or vinyl, although materials known in the art may also be utilized without departing from the broader aspects of the invention. The garment bag 18 is sealable or closable so as to be generally or substantially fluid tight, as discussed in detail hereinafter. As used herein, "fluid tight" means sufficiently sealed so as to maintain an expanded (or three dimensional) shape when a flow of steam or air is passed into the garment bag 18. In an embodiment, the garment bag may include one or more handles allowing for easier handling and manipulation of the bag 18.

Figure 24:
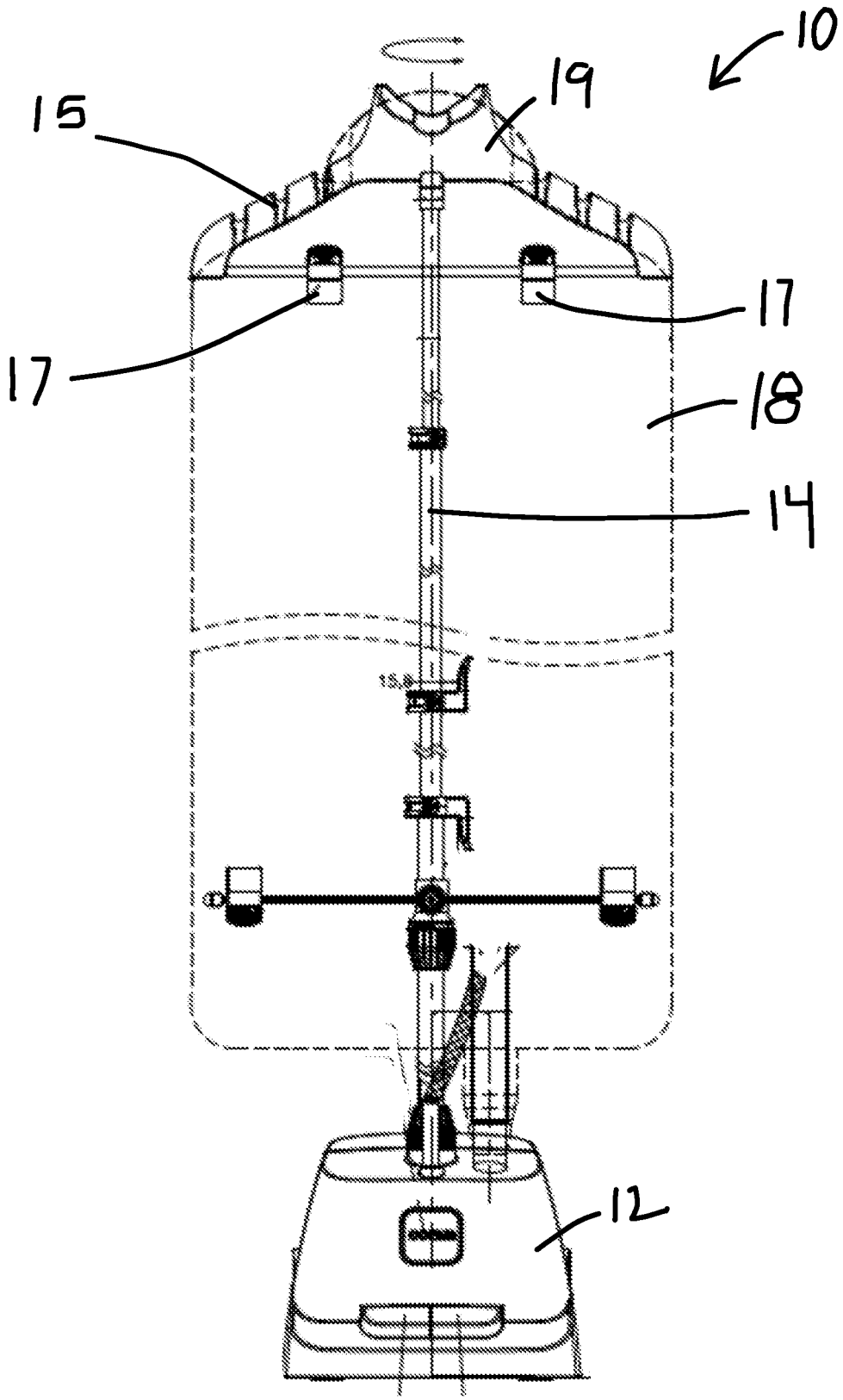
FIG. 24 is a front elevational view of the garment treatment device of FIG. 1.
Figure 25:
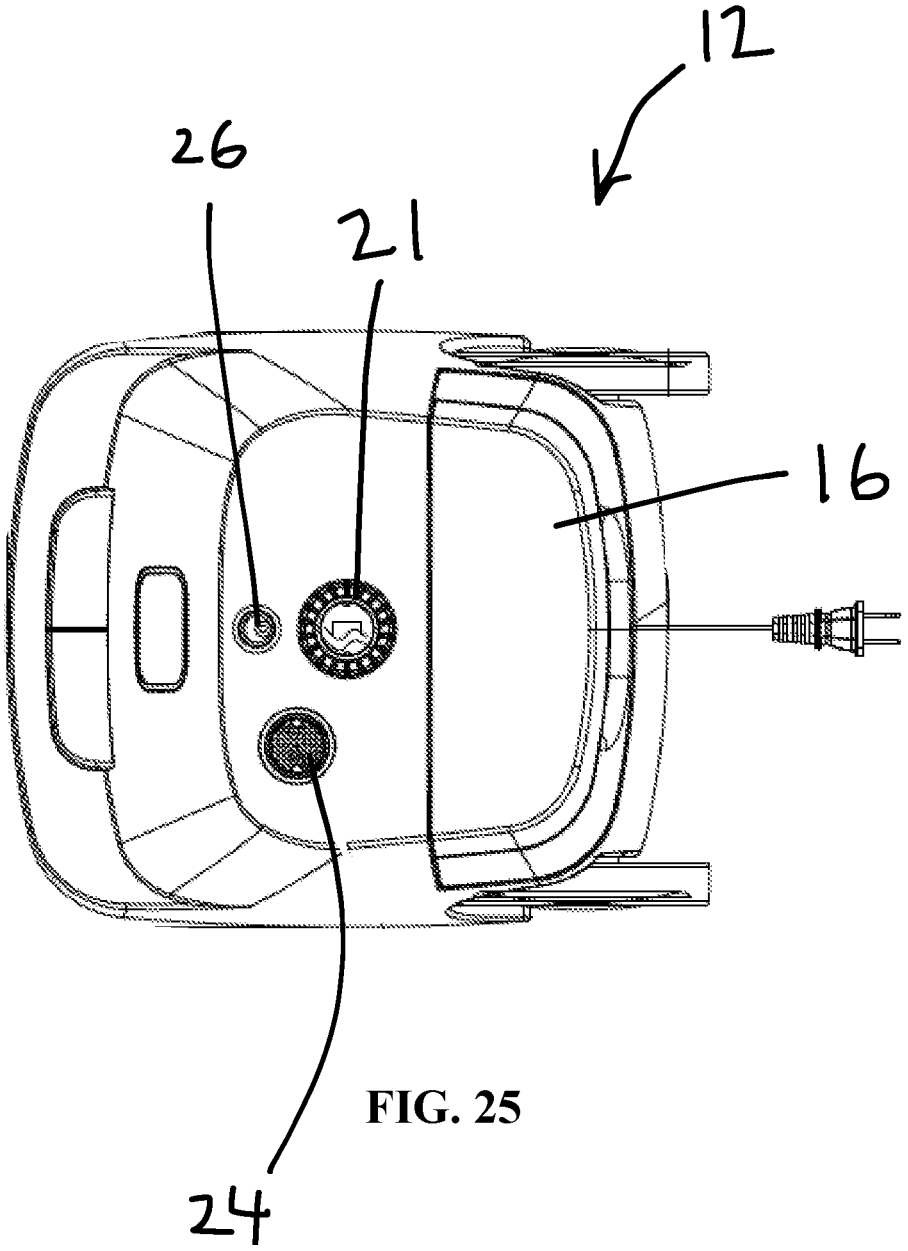
FIG. 25 is a top plan view of the base of the garment treatment device of FIG. 1, according to an embodiment of the present invention.
Figure 26:
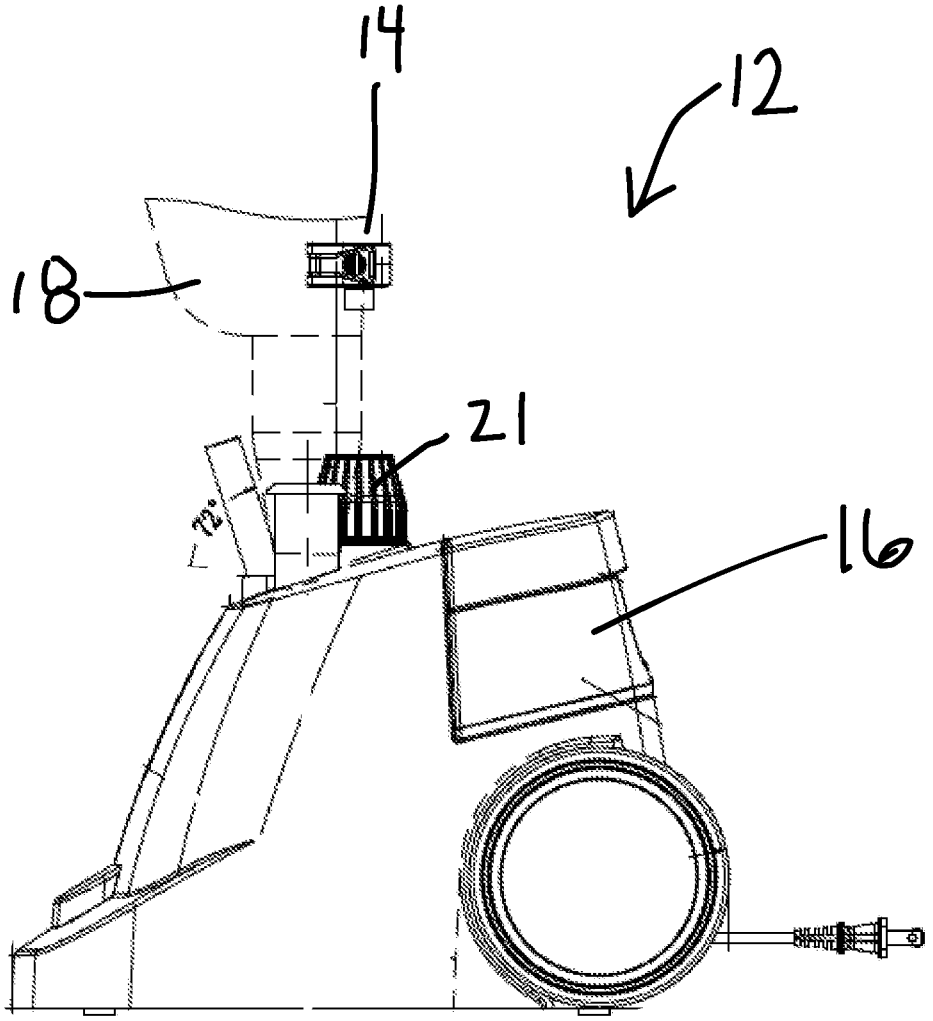
FIG. 26 is a side elevational view of the base of FIG. 25.
Figure 30:
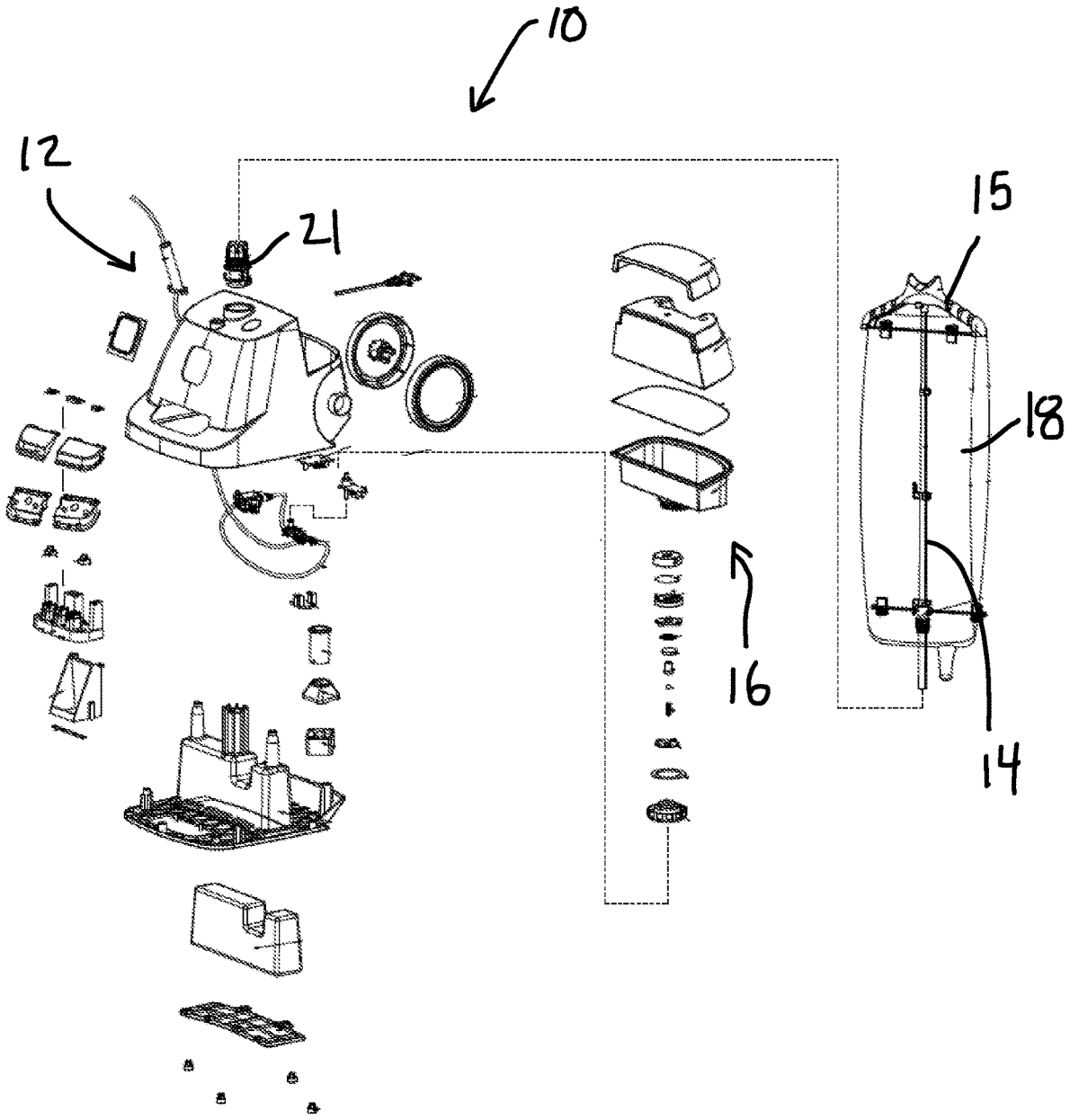
FIG. 30 is an exploded, perspective view of the garment treatment device of FIG. 1, according to an embodiment of the present invention.

Alternatively, as shown in FIGS. 24 and 30, the top of the pole 14 may be outfitted with a hanger 15 for hanging garments, over which the garment bag 18 may be placed. As illustrated, the hanger 15 may include a pair of pant clips 17 for hanging pants or other items. In either configuration, the pole 14 may be rotatably connected to the base through collar 21, allowing for easier use during operation. In an embodiment, the upper portion of the hanger 15 may form a cradle 19 for receiving a handheld steam nozzle 48, as described hereinafter.

As best shown in FIGS. 1, 25, 26 and 30, the base 12 includes a pair of ports 24, 26 that are in fluid communication with the steam generator for receiving a flow of steam therefrom. In an embodiment, the ports 24, 26 may be formed as valves. The first port 24 is fluidly connected or connectable to the garment bag 18 through tubing 28 so as to allow steam generated in the base 12 to flow upwardly into the garment bag 18 through port 30 in the garment bag 18, as described hereinafter.

Figure 3:
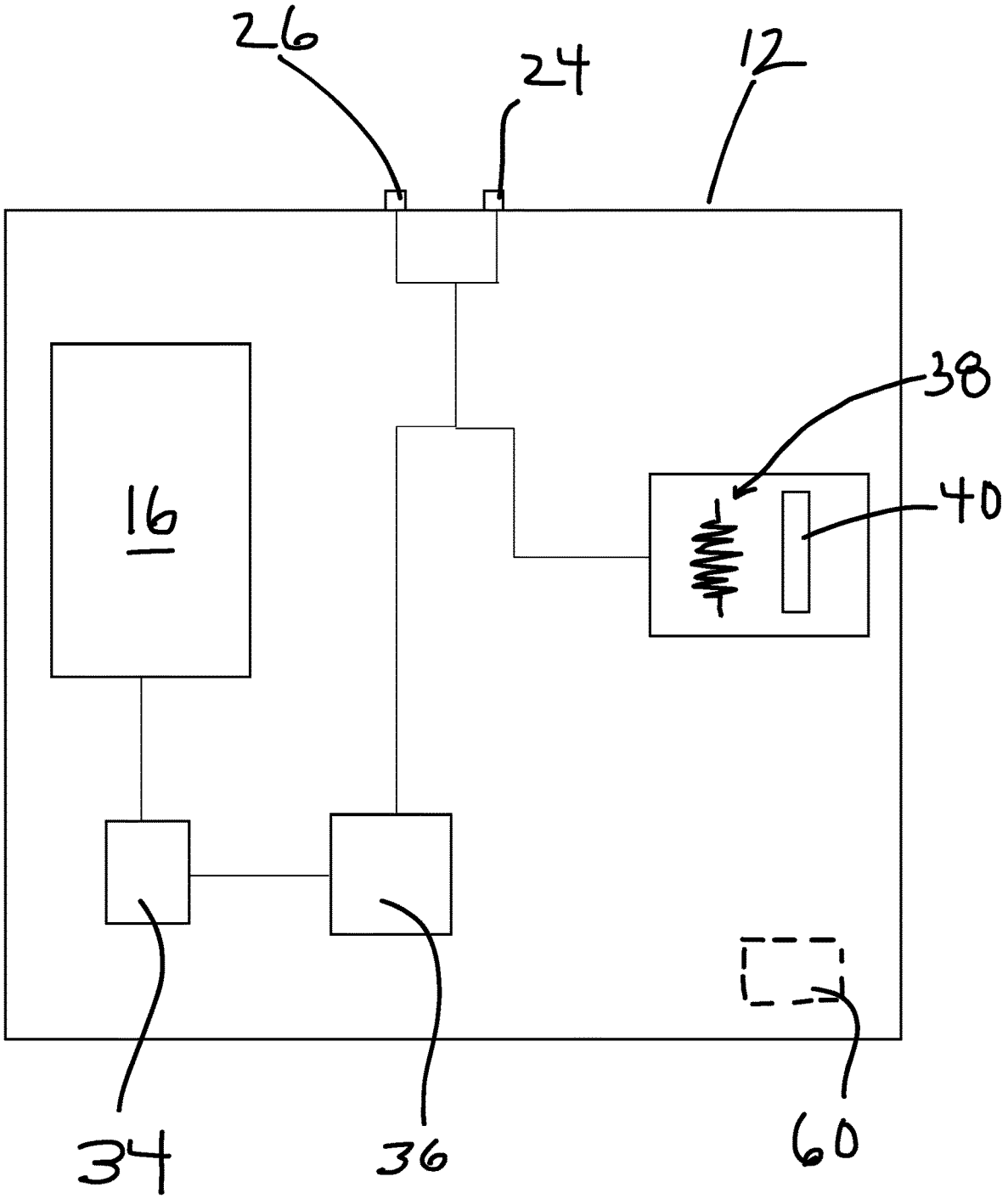
FIG. 3 is a schematic illustration of the operational components housed in the base of the garment steaming device of FIG. 1.

With reference to FIG. 3, a schematic illustration of the components of the base 12 is shown. As indicated above, the base 16 includes the water reservoir 16, pump 34 in fluid communication with the water reservoir 16, and steam generator 36 in fluid communication with the pump 34. As also shown therein, in an embodiment the base 12 may include a fan 40 configured to draw air into the base 12 and pass the air across a heating element 38 for heating the air. As illustrated, the steam generator 36 and heating element 38 and fan 40 are in selective fluid communication with the ports 24, 26 so that steam and/or hot air may be selectively deliver to the ports 24, 26 for the purposes disclosed hereinafter. In connection with this, the passageways or tubing connecting the steam generator to the ports and/or the fan and heating element to the ports may be outfitted with flow control valves (not shown). The garment treatment device 10 also includes a control unit or processor 60 in communication (e.g., a wired or wireless connection) with the pump 34, steam generator 36, heating element 38, fan 40, and associated valves or flow control devices along the passageways/tubing for controlling operation of such components in response to user inputs (e.g., actuation of mode-control buttons and the like) on the base 12).

While port 24 has been described above as being configured to facilitate the passage of steam from the base 12 to the bag 18, in an embodiment, port 24 may be a dedicated air port in fluid communication with the heating element 38 and fan 40, while port 26 may be fluidly connected to the water tank 16 and steam generator 36 for delivering steam and/or water from the base 12 to the bag 18.

Figure 2:
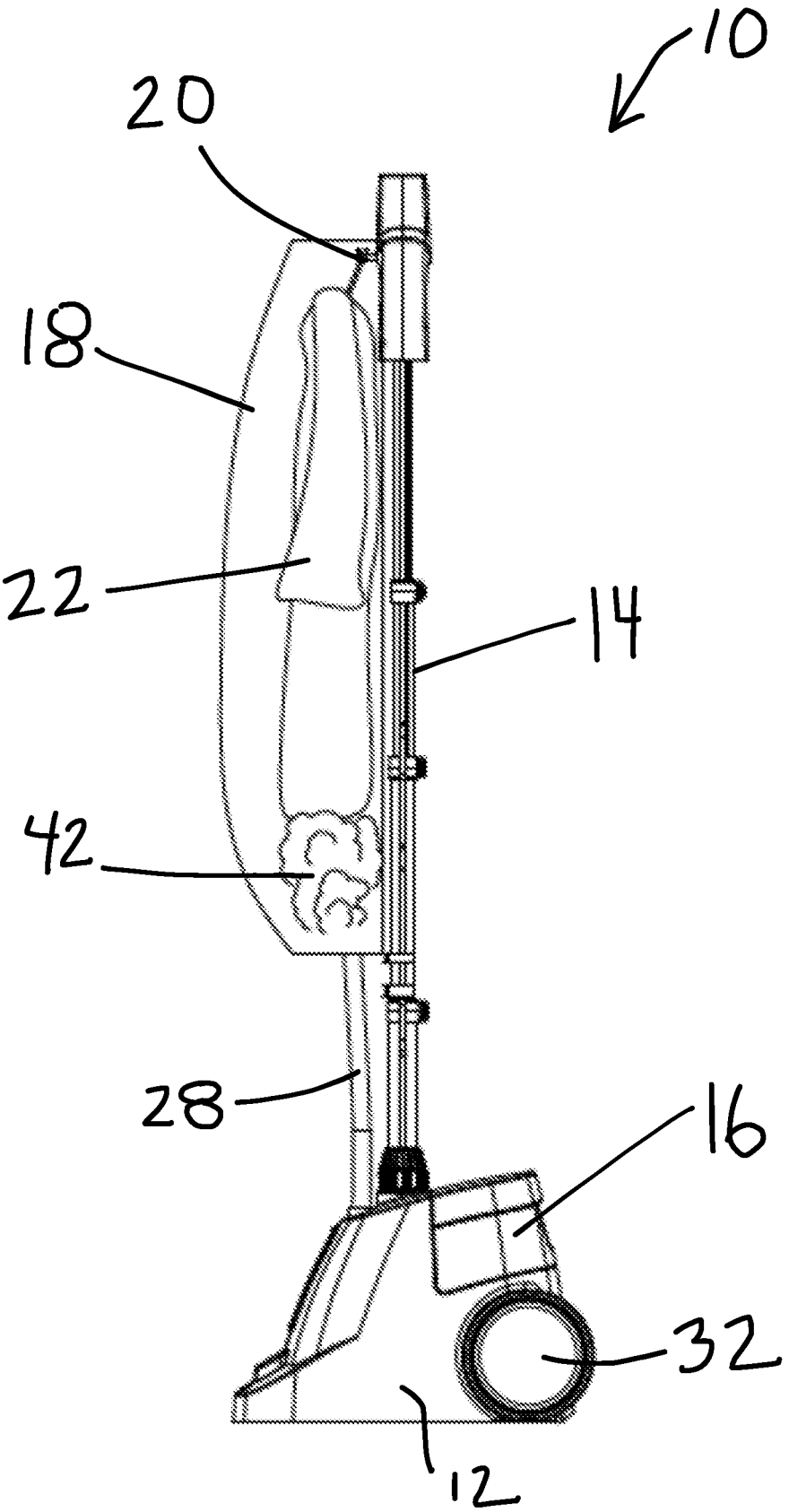
FIG. 2 is a side elevational view of the garment steaming device of FIG. 1.

As shown in FIGS. 1 and 2, in a first mode of operation (referred to herein as a steaming or steam refresh mode), the steam generator 36 may be controlled by controller 60 to generate steam 42 which is directed to port 24 (or port 26, where port 24 is a dedicated air port), into tubing 28, and into the garment bag 18 through port 30. This hot and humid steam 42 functions to remove wrinkles, sterilize and remove odors from the garment 22 within the garment bag 18.

Figure 4:
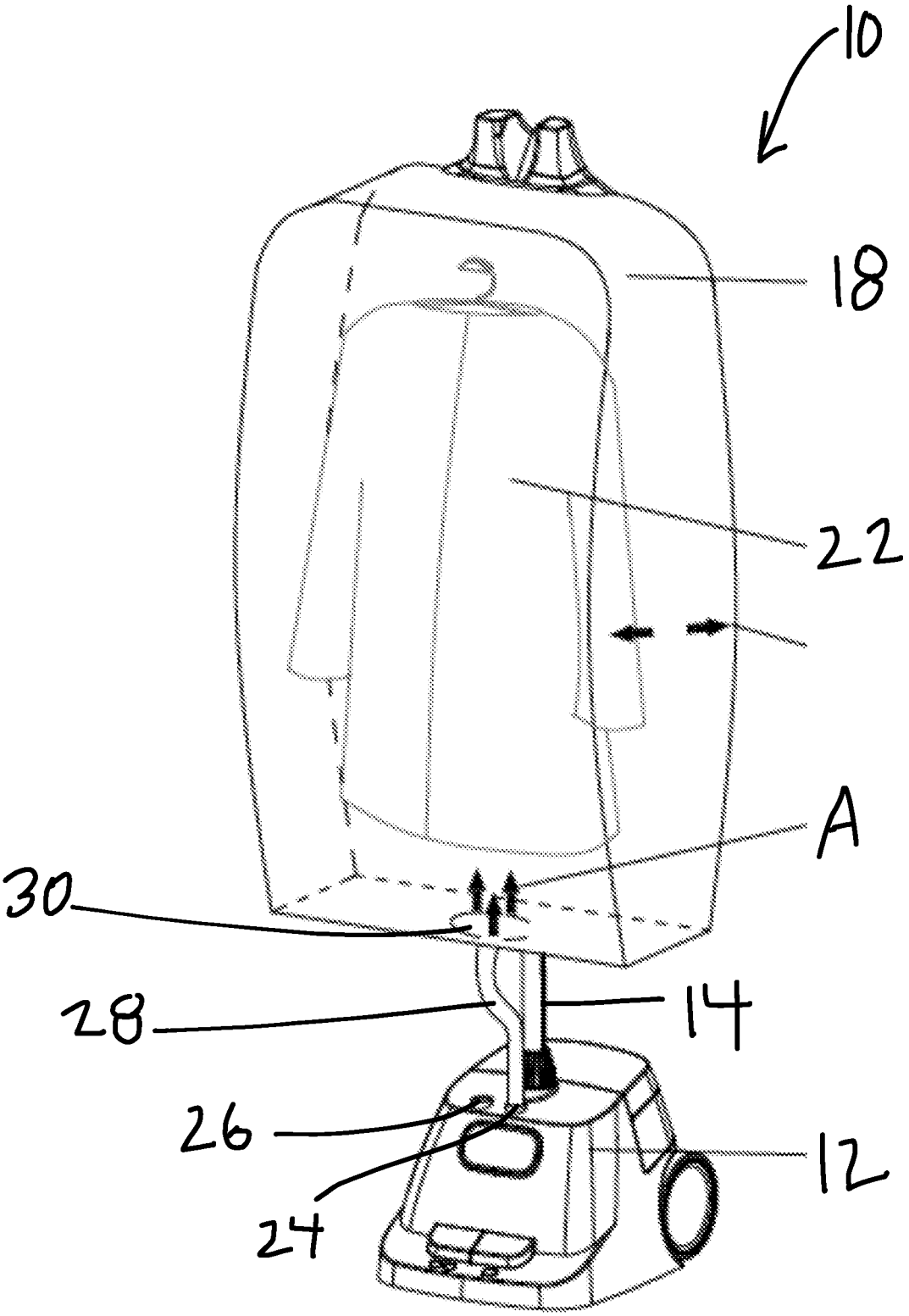
FIG. 4 is a front, perspective view of the garment steaming device of FIG. 1, illustrating a drying mode of operation.
Figure 5:
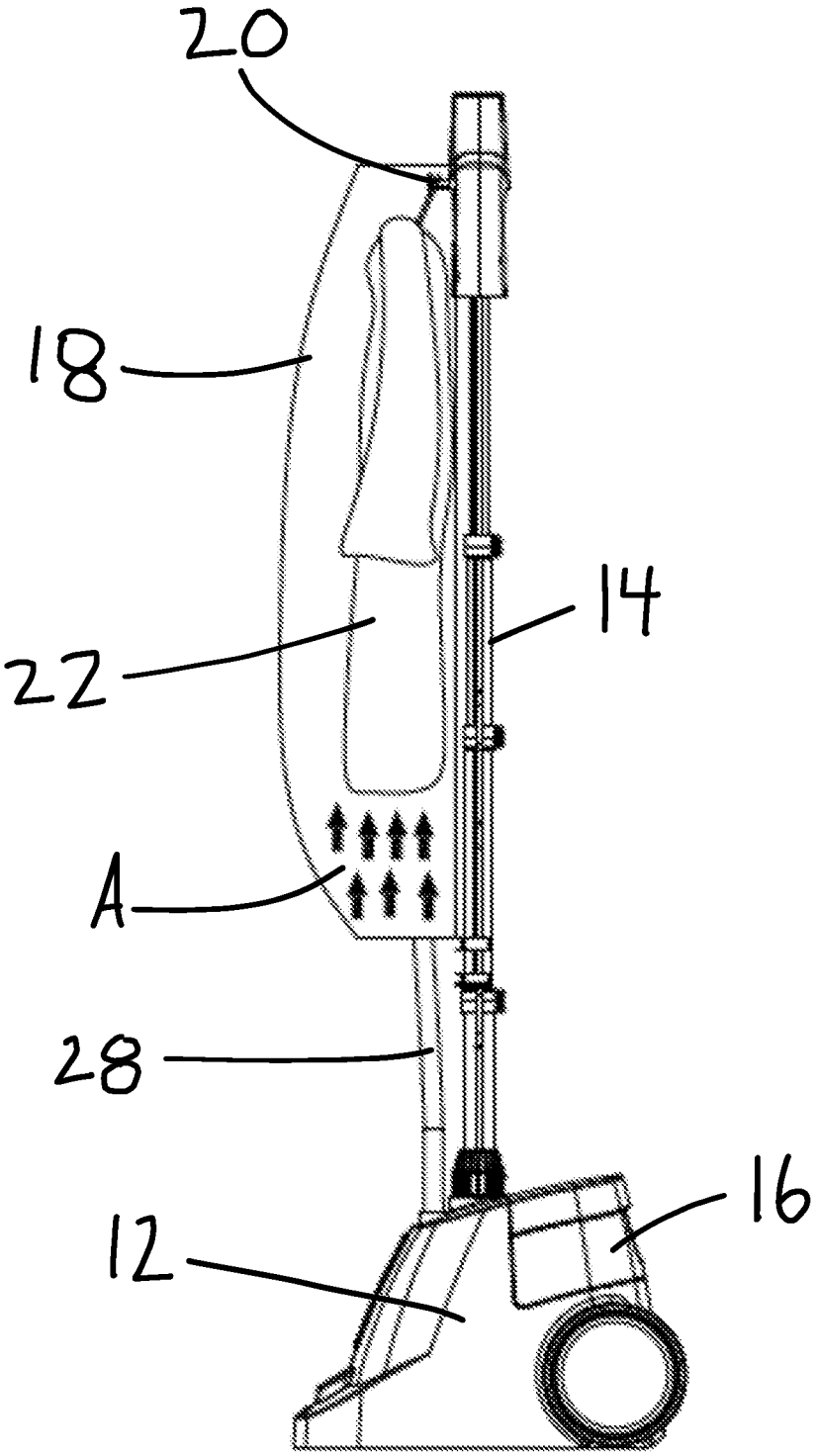
FIG. 5 is a side elevational view of the garment steaming device of FIG. 1, illustrating the drying mode of operation.

With reference to FIGS. 4 and 5, in a second mode of operation (referred to herein as hot air drying), the heating element 38 and fan 40 may be controlled by the controller 60 to produce hot air which is directed to port 24, into tubing 28, and into the garment bag through port 30. As used herein, "hot air" or "warm air" means air that is at a temperature in excess of ambient temperature. In an embodiment, "hot air" may be above approximately 100 degrees Fahrenheit and, more preferable above 125 degrees Fahrenheit. In an embodiment, it is contemplated that the hot air drying mode may be carried out subsequent to the steaming/steam refresh mode. The hot air which is delivered to the interior of the bag 18 moves upwardly through the bag 18 as indicated by arrows, A, and fills up the bag 18, helping dry and de-odor the garment 22. In particular, as the hot air moves through and across the garment 22, it will draw and carry moisture and odor particles away from the garment 22.

Figure 6:
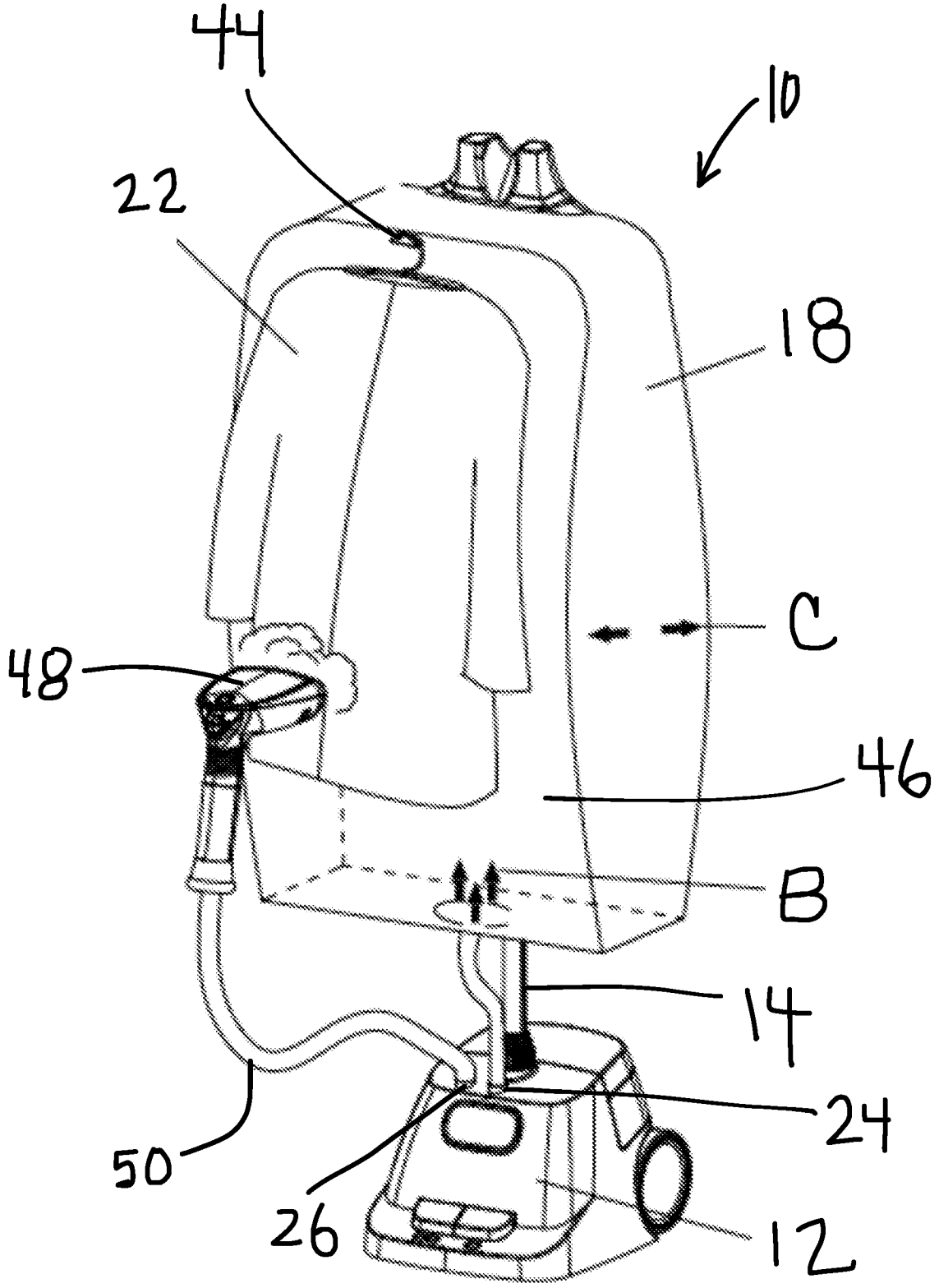
FIG. 6 is a front, perspective view of the garment steaming device of FIG. 1, illustrating an ironing mode of operation.
Figure 7:
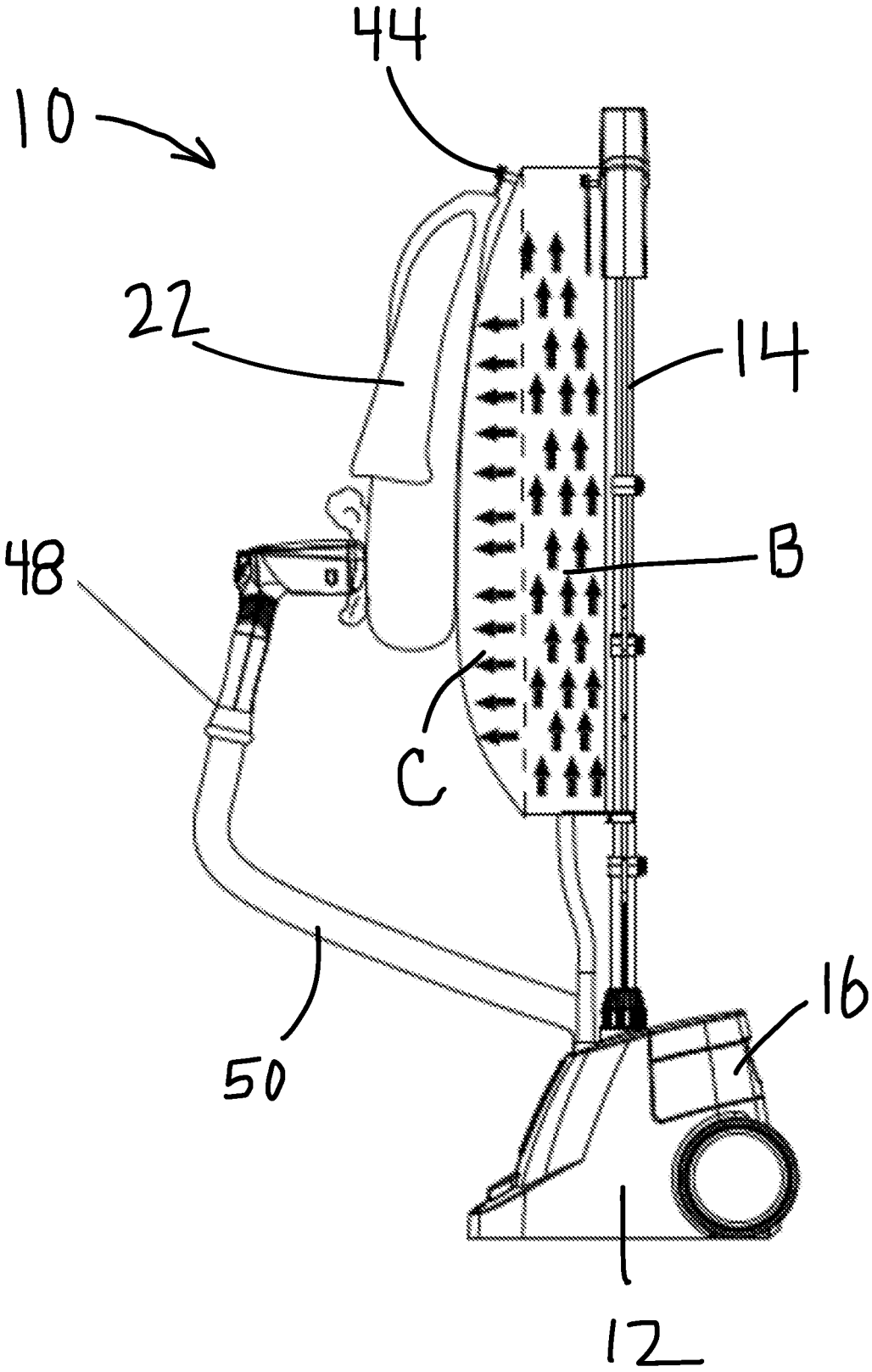
FIG. 7 is a side elevational view of the garment steaming device of FIG. 1, illustrating the ironing mode of operation.

Turning now to FIGS. 6 and 7, in a third mode of operation (referred to herein as an ironing mode of operation), the garment bag 18 may be inflated to produce a generally rigid front-facing surface 46 for use as an ironing board. In particular, in an ironing mode of operation, the garment 22 may be removed from the garment bag 18 and placed on a hook 44 extending from the front face (outside) of the bag 18. The heating element 38 and fan 40 (or simply the fan 40) may then be controlled by the controller 60 to direct air through the port 24 in the base 12, through tubing 28, and into the garment bag 18 through port 30, as represented by arrows, B. The air passed into the bag 18 inflates the bag 18 in the direction of arrows, C. This outward pressure exerted by the air entering the bag 18 provides a semi-rigid, cushioned surface at the front of the bag 18 against which the garment 22 may rest when supported by hook 44.

As further shown therein, in the ironing mode of operation, a handheld steam nozzle 48 may be fluidly connected to the second port 26 on the base 12 via flexible tubing 50. The steam generator 36 may then be controlled by the controller 60 to generate steam which is passed through port 26, to the handheld steam nozzle 48. The steam nozzle 48 may then be manipulated by a user to iron and/or steam the garment 22 while it is supported on the front face 46 of the garment bag 18 while the garment bag 18 is inflated. Importantly, the inflated bag 18 provides a supporting surface which helps remove wrinkles more efficiently when using the steam nozzle 48, and aids in movement of the steam nozzle 48 across the garment 22.

Figure 28:
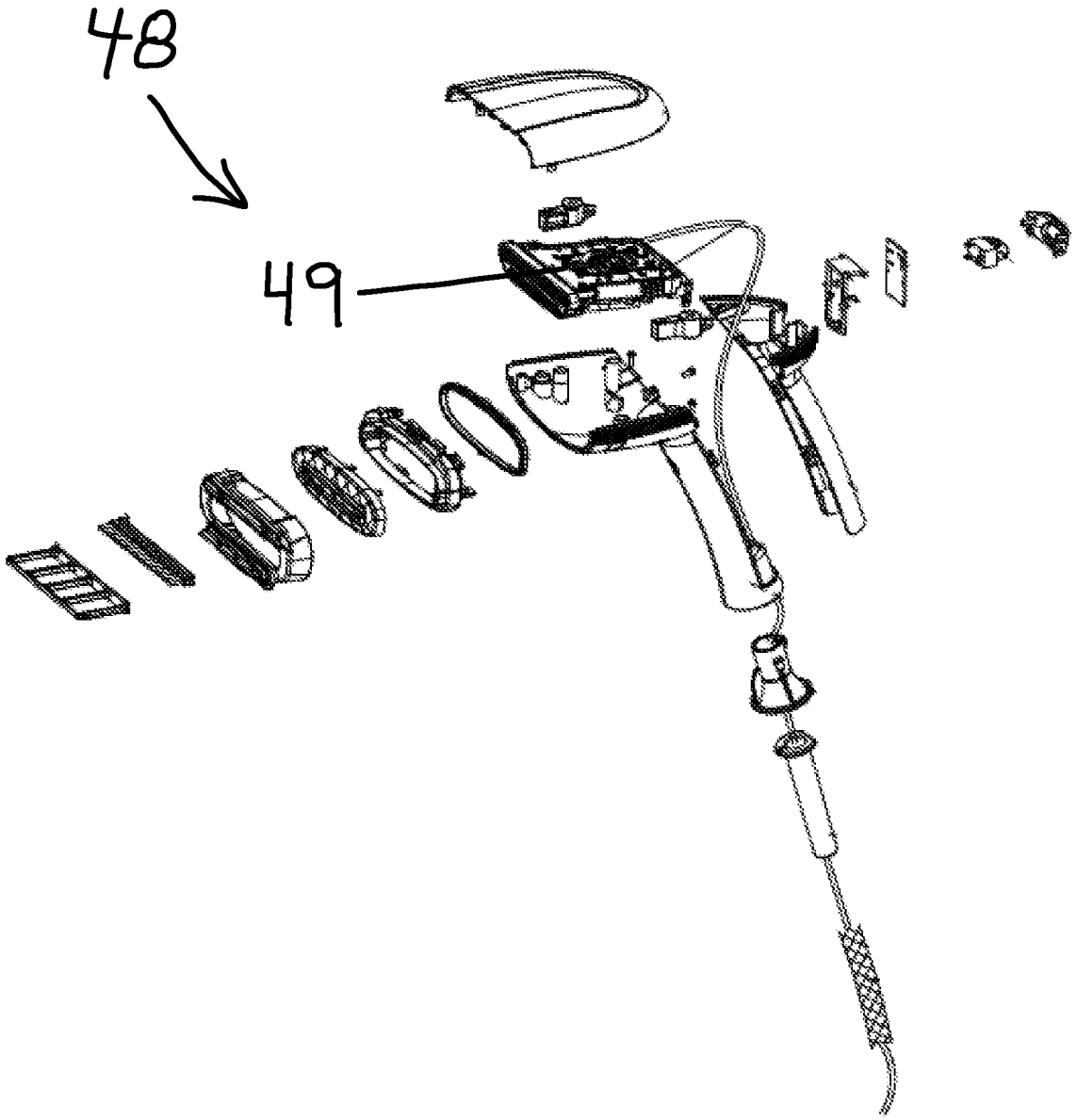
FIG. 28 is an exploded, perspective view of a handheld steam nozzle of the garment treatment device of FIG. 1, according to an embodiment of the present invention.
Figure 29:
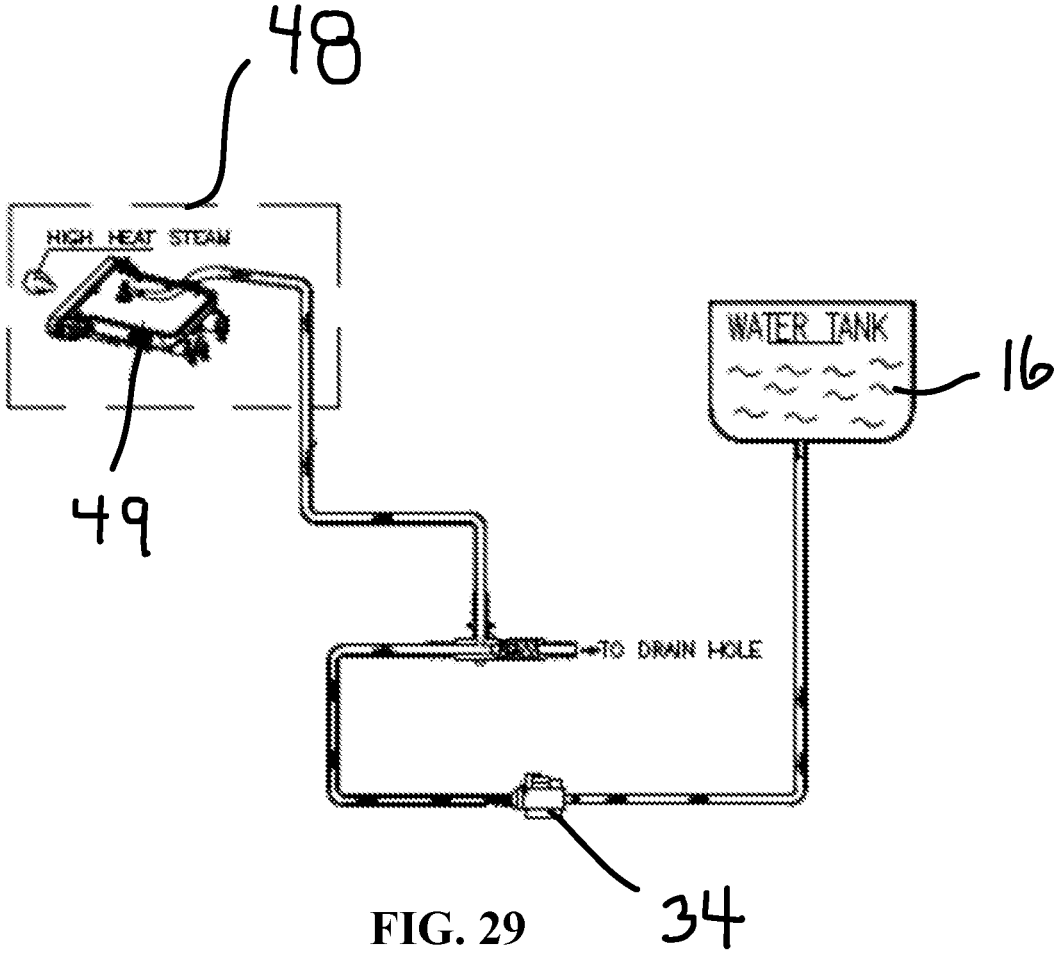
FIG. 29 is a schematic illustration of the handheld steam nozzle, illustrating operation thereof.

With reference to FIGS. 28 and 29, in an embodiment, rather than the steam being generated by the steam generator 36 in the base 12 in the ironing mode of operation, it is contemplated that the handheld steam nozzle 48, itself, may generate the steam via a separate steam generator or boiler 49 located within the nozzle 48. In particular, in such an implementation, the steam generator 36 may be deactivated by the control unit (when the ironing mode of operation is selected by a user) such that the pump 38 pumps water from the reservoir/tank 16 to the handheld steam nozzle 48 through the connected tubing. Alternatively, the tubing in the base may be configured such that the steam generator 36 can be bypassed entirely. By locating a boiler 49 in the steam nozzle, itself, temperature losses are mitigated, as the steam only has to travel a very short distance before exiting the openings in the head of the nozzle 48. This configuration may therefore increase performance of the device 10 in the ironing mode of operation.

Figure 27:
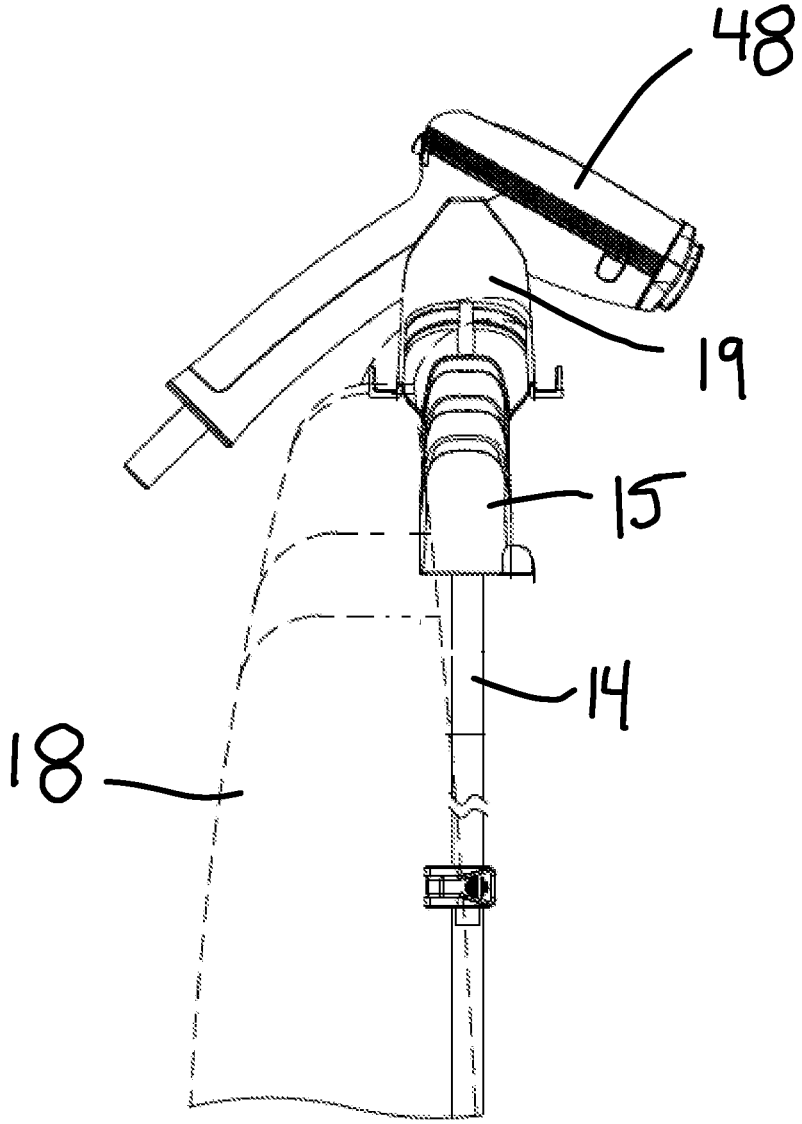
FIG. 27 is an enlarged, side elevational view of a portion of the garment treatment device of FIG. 1.

In some embodiments, it is contemplated that the garment bag 18 may serve as a support for the garment 22 during an ironing mode of operation, even in cases where the bag 18 is not inflated (depending on the manner in which the garment bag 18 is supported on the pole 14). In still further embodiments, the front of the garment bag 22 may have an array of outlet apertures for directing hot air and/or steam onto the garment 22 as it is supported on the front surface 46. As indicated above, and as best shown in FIG. 27, the upper portion of the hanger 15 is formed as a cradle 19 that is configured to receive and retain the handheld steam nozzle 48.

Figure 8:
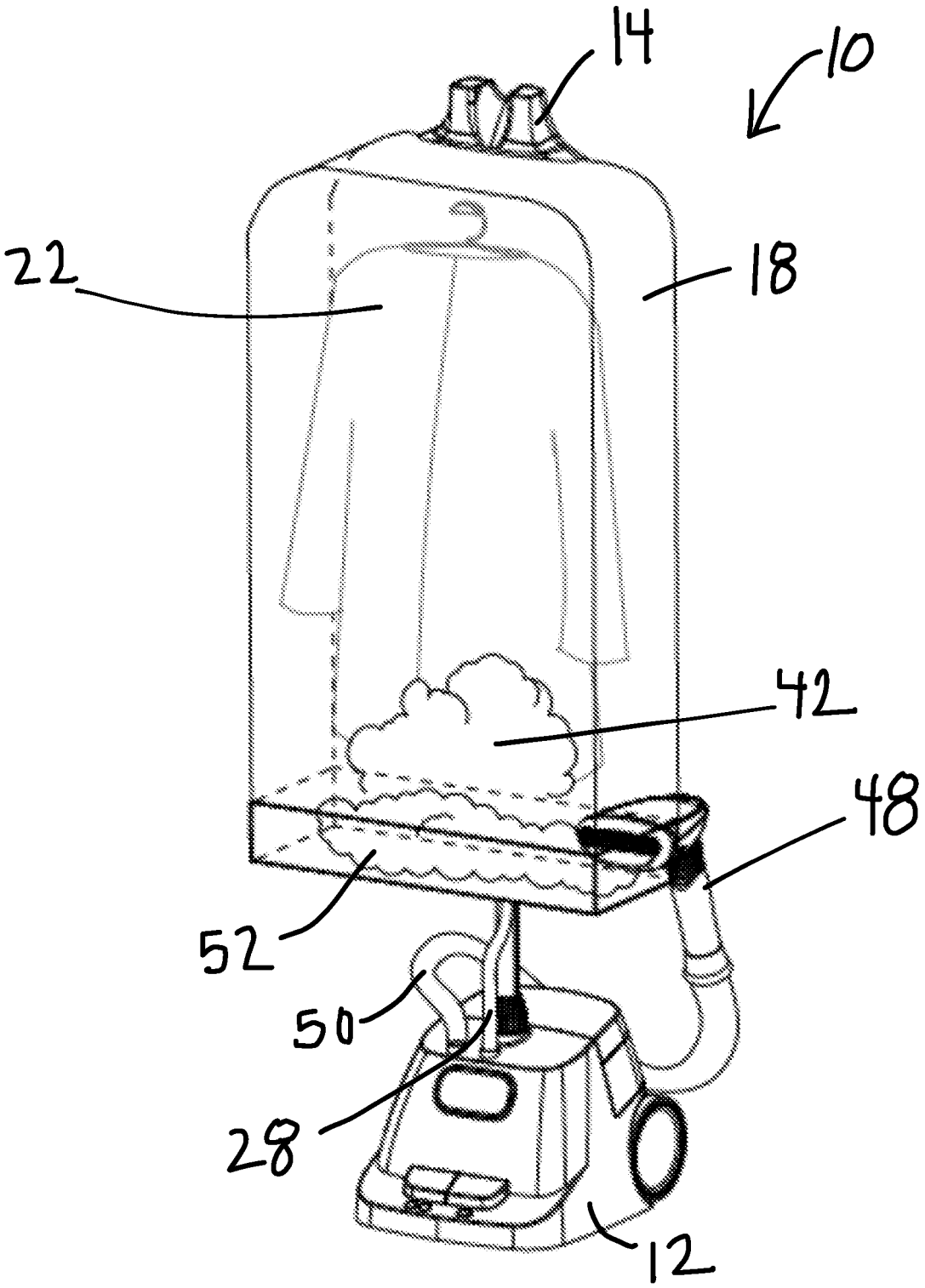
FIG. 8 is a front, perspective view of a garment steaming device according to another embodiment of the present invention, illustrating a steaming operation.
Figure 9:
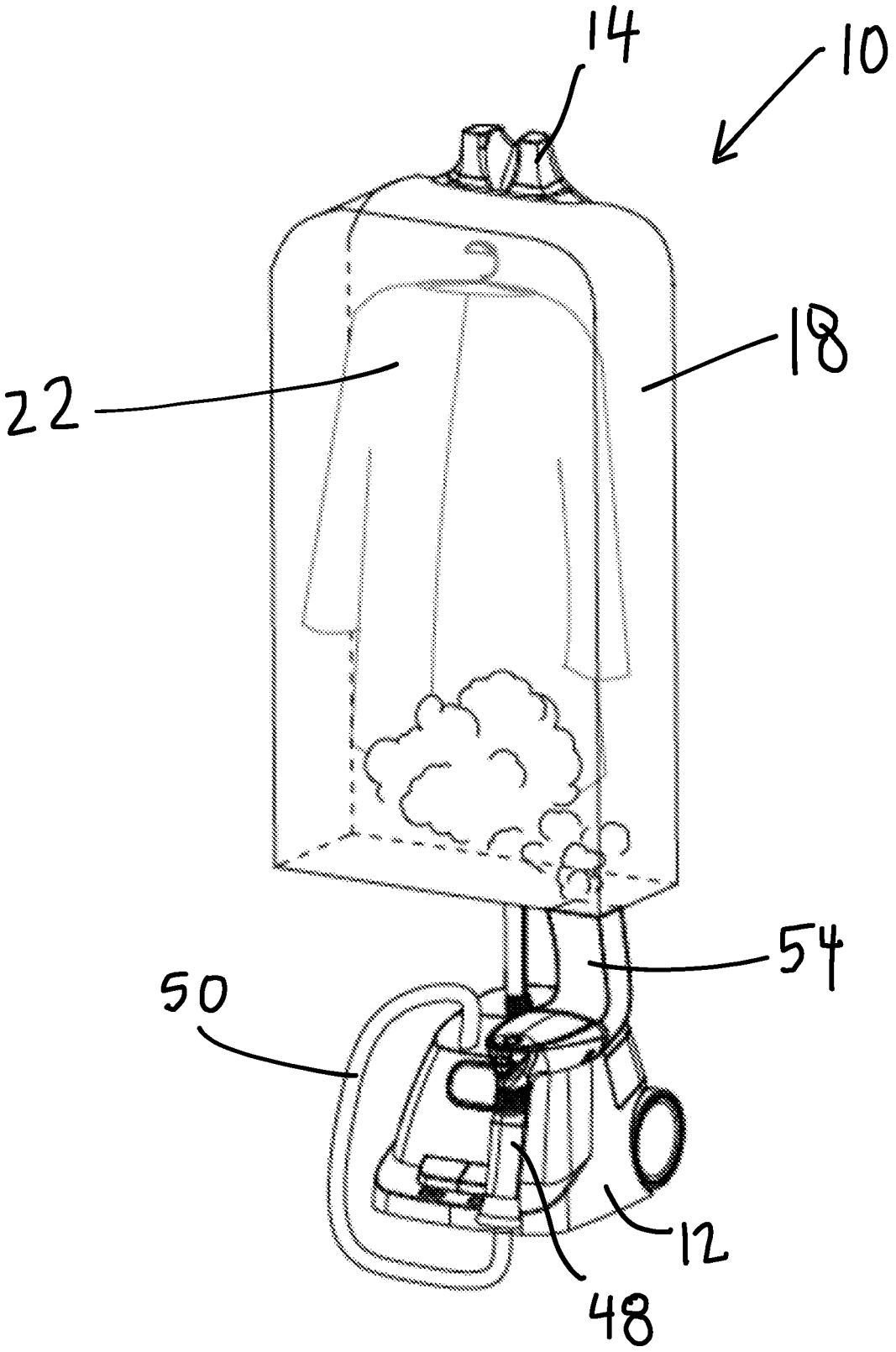
FIG. 9 is a front, perspective view of a garment steaming device according to another embodiment of the present invention, illustrating a steaming operation.

Turning now to FIGS. 8 and 9, alternative configurations of the garment treatment device 10 is shown. For example, as shown in FIG. 8, in addition to, or instead of, directing steam into the garment bag 18 through tubing 28, the hand-held steam nozzle 48 may be selectively connected directly to a closable port in the bag 18 (e.g., in the rear of the bag 18) for delivering steam 52 directly into the bag 18. In particular, this steam 52 from nozzle 48 may supplement or replace steam 42 delivered from tubing 28.

Alternatively, as shown in FIG. 9, the garment treatment device 10 may include a connector 54 fluidly connected at one end to a port in the bag 18, and having an opposite end configured to receive, or connect to, the output of the handheld steam nozzle 48. In an embodiment, the connector 54 may be generally L or elbow shaped.

In either implementation, a user can use the steam nozzle 48 for normal steam ironing, and switch to the steam refresh mode of operation/function when the nozzle 48 is placed on the base and/or connected so as to deliver steam to the bag 18. Notably, these configurations only require a single steam generator.

Figure 10:
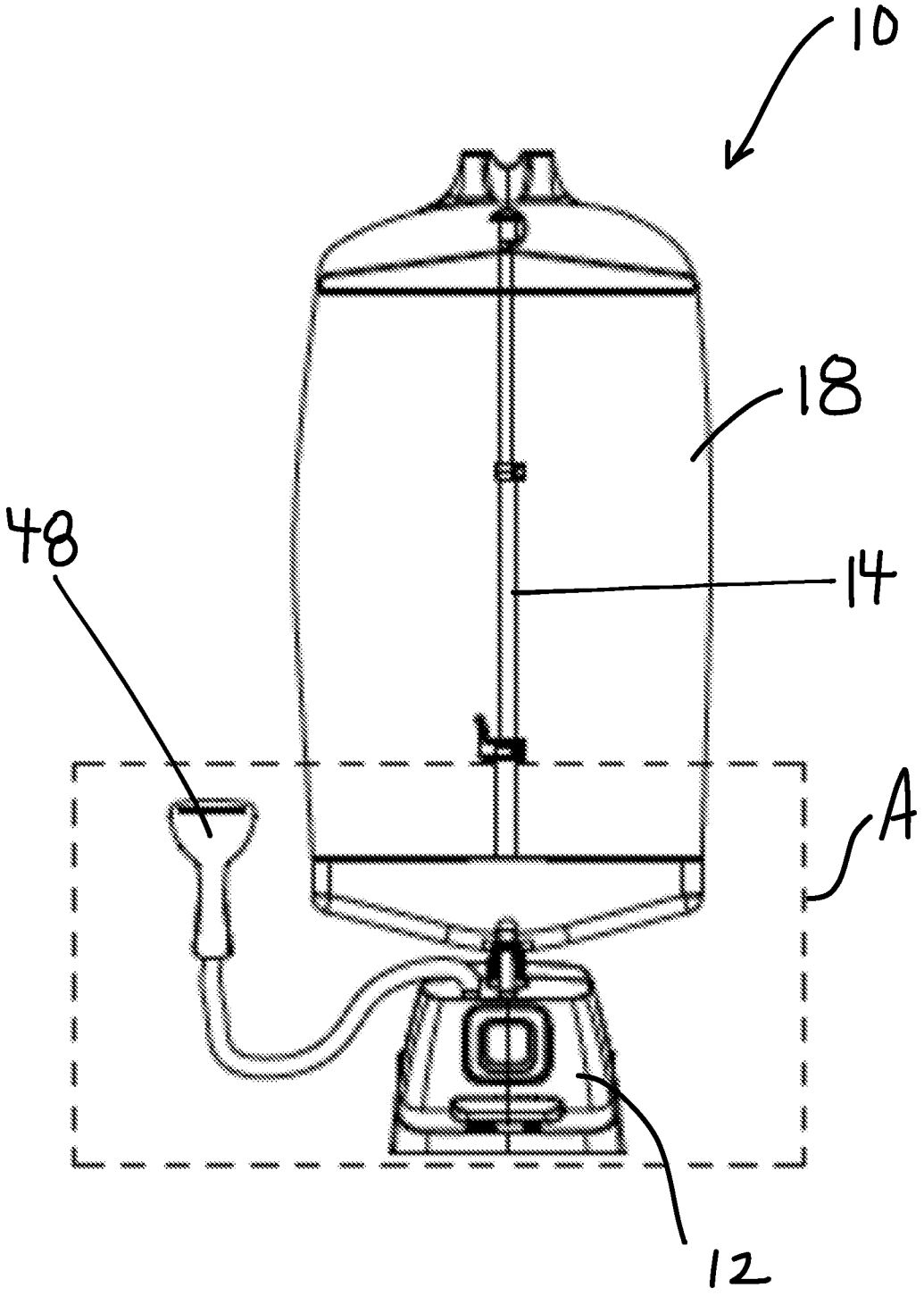
FIG. 10 is a front elevational view of a garment steaming device according to another embodiment of the present invention.
Figure 11:
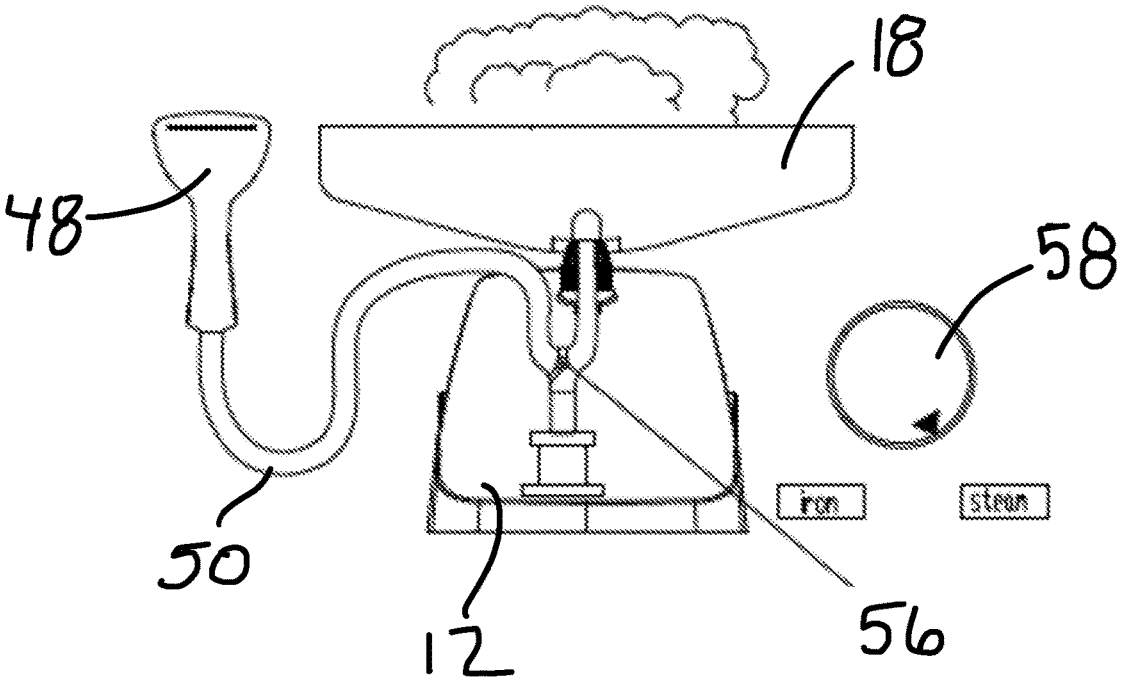
FIG. 11 is an enlarged view of area A of FIG. 10, illustrating an iron mode of operation.
Figure 12:
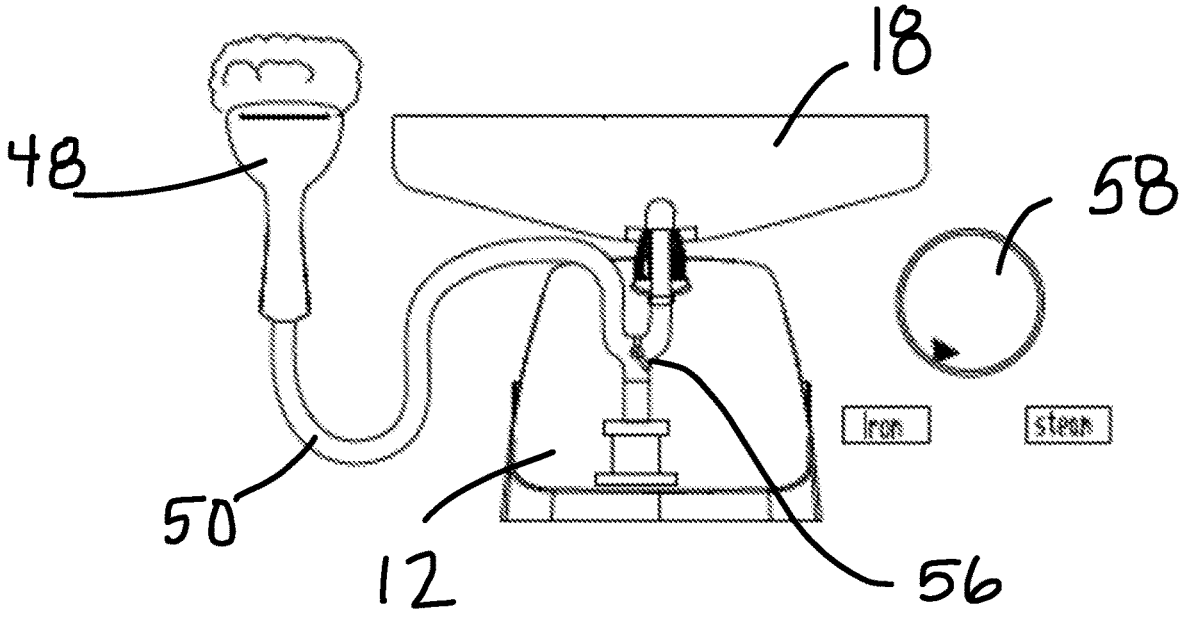
FIG. 12 is an enlarged view of area A of FIG. 10, illustrating a steaming mode of operation.

FIG. 10-12 illustrate an alternative configuration for delivering steam to the garment bag 18 in the steam refresh mode of operation. As best shown in FIGS. 11 and 12, a steam valve 56 can be selectively actuated by turning a dial 58 on the base 12 (to an ironing position or a steam refresh position). The steam valve 56 may be, for example, a mechanical or electronic (e.g., solenoid) valve and may be controlled either directly with dial 58 or via the controller 60. For example, as illustrated in FIG. 11, in the ironing position, the valve 56 is controlled to a position which enables steam to flow into the garment bag 18 (e.g., through tubing 28). As illustrated in FIG. 12, in the steam refresh position, the valve 56 is controlled to a position which enables steam to flow to the handheld steam nozzle 48.

Figure 13:
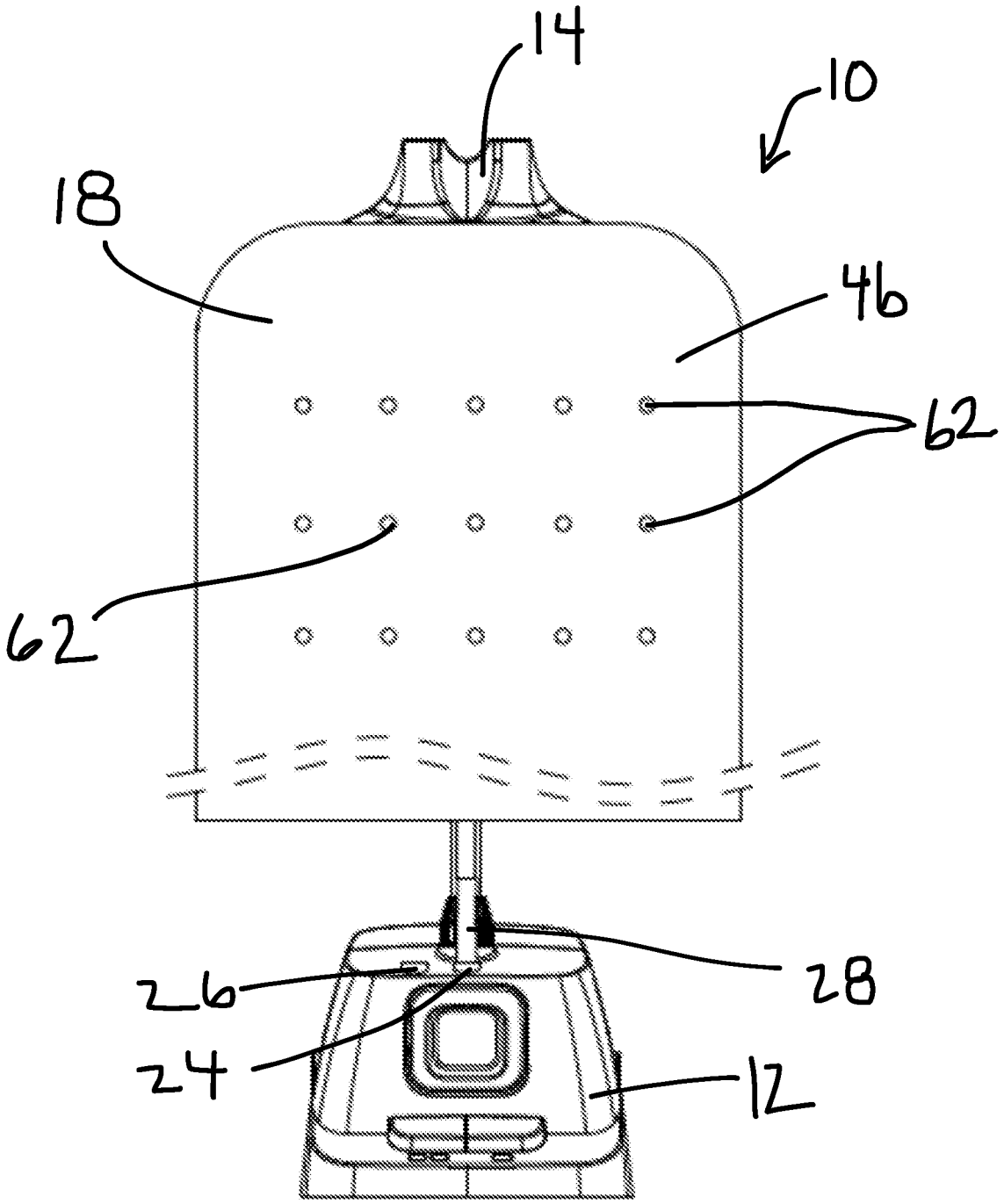
FIG. 13 is a top plan view of the garment steaming device of FIG. 1.
Figure 14:
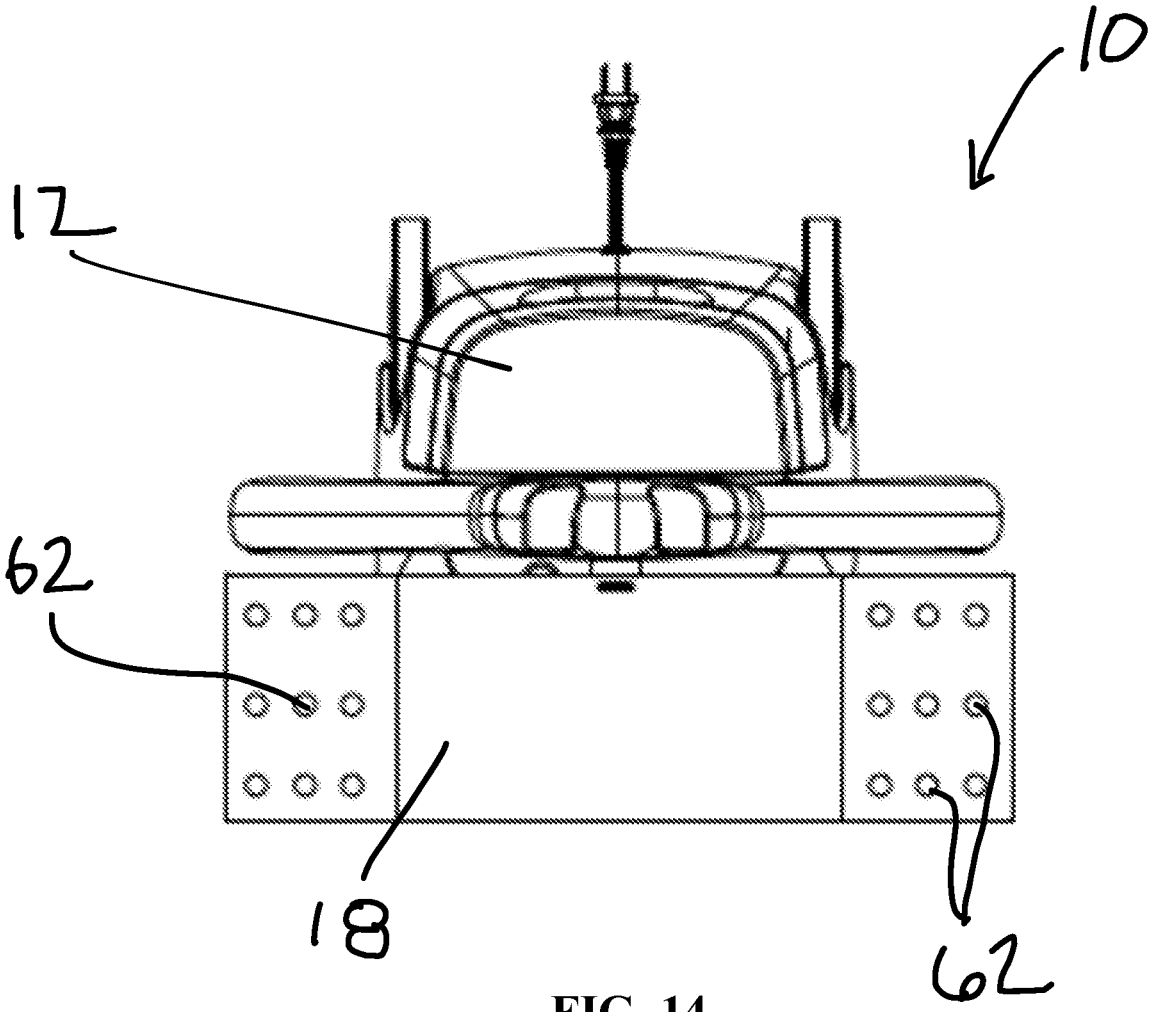
FIG. 14 is a front plan view of the garment steaming device of FIG. 1.

Turning now to FIGS. 13 and 14, more detailed views of the garment bag 18 are shown. As shown therein, the garment bag 18 has a plurality of apertures or outlets 62 on the top and front 46 of the bag 18. In other embodiments, the outlets 62 may be in the front, top, sides and/or bottom of the bag 18. These outlets 62 permit steam and/or air to exit the bag 18 so as to limit the pressure inside the bag 18. In addition, the outlets 62 in the front of the bag 18 allow steam to impinge upon the garment 22 when supported by the front of the bag 18 in the ironing mode of operation, as indicated above.

Figure 15:
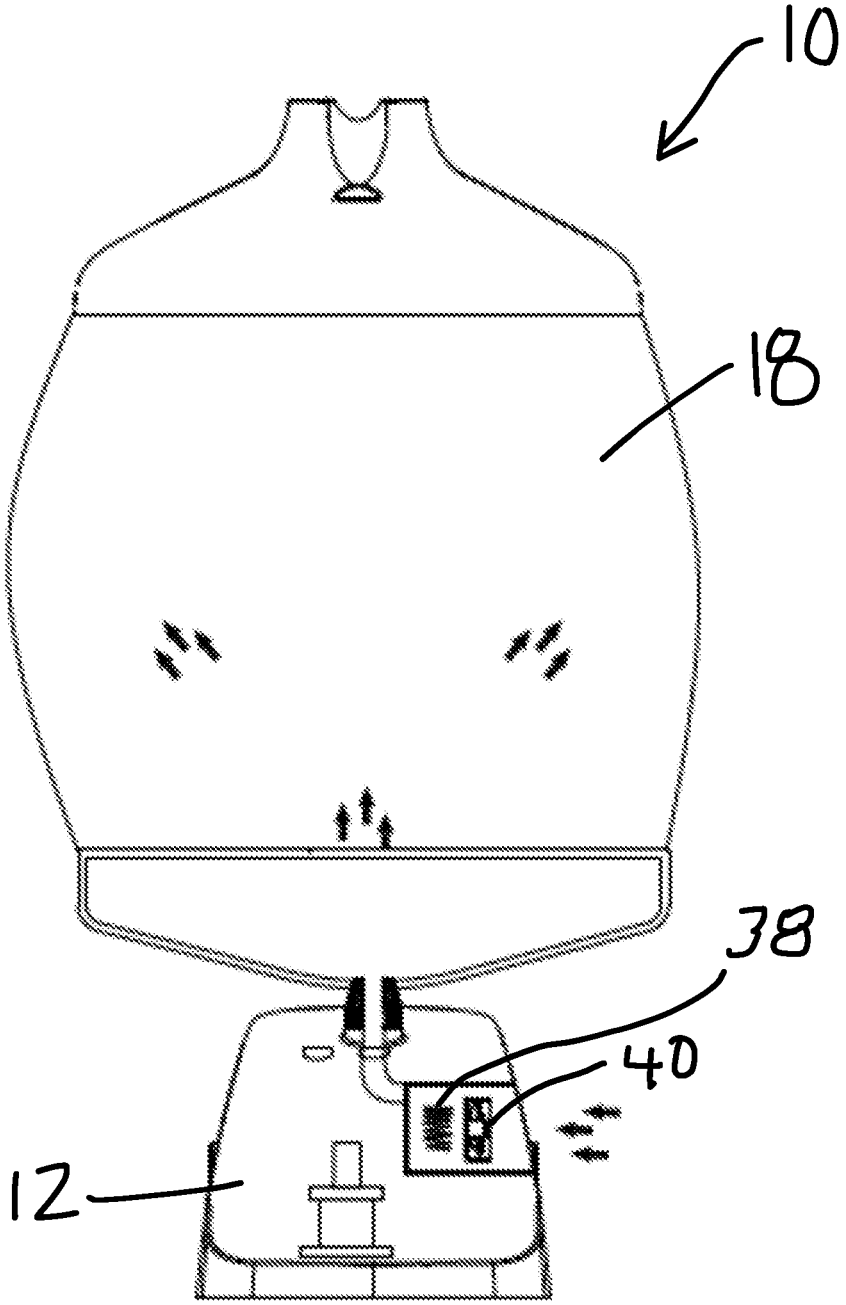
FIG. 15 is a front elevational view of a garment steaming device according to another embodiment of the present invention.
Figure 16:
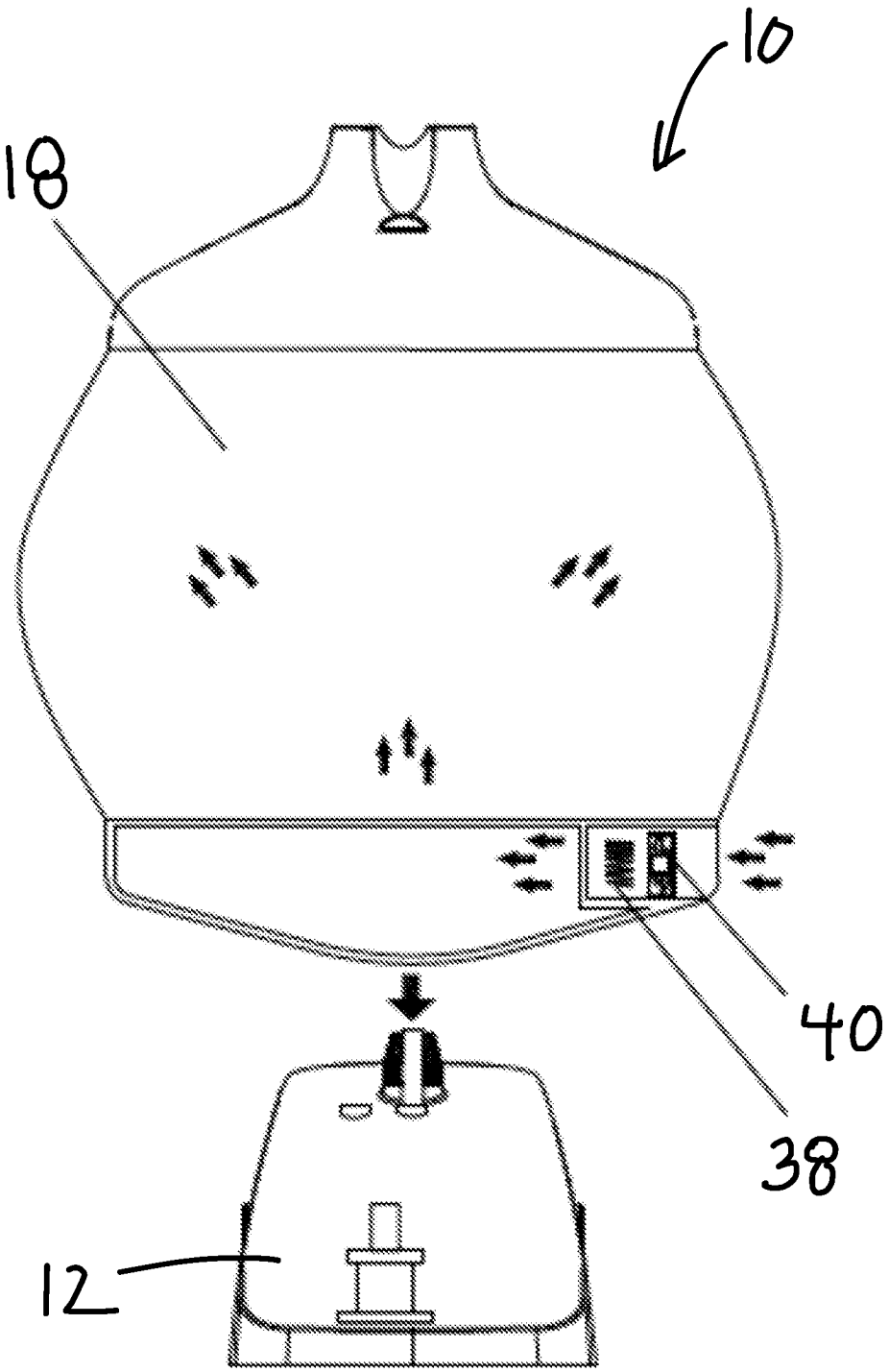
FIG. 16 is a front elevational view of a garment steaming device according to another embodiment of the present invention.
Figure 17:
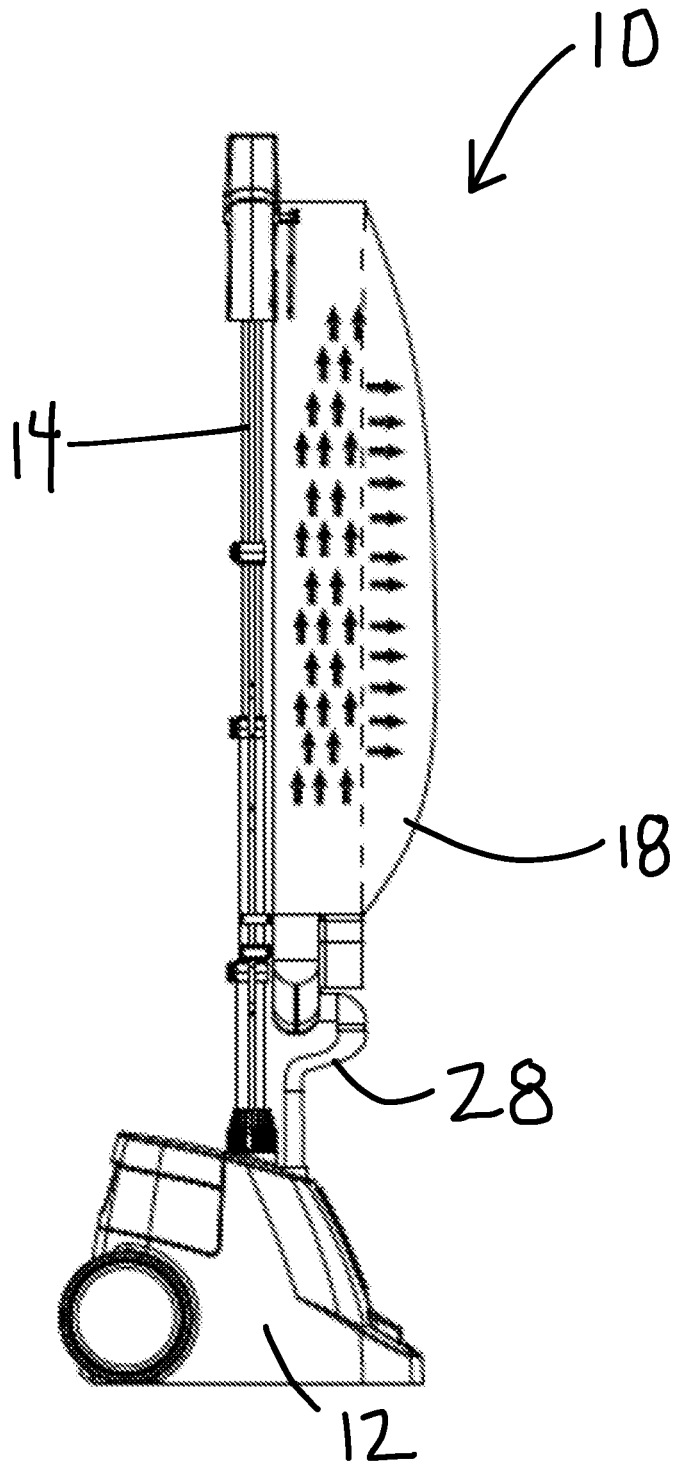
FIG. 17 is a side elevational view illustrating operation of the garment steaming device of FIG. 15 or 16.

With reference to FIGS. 15 and 16, various means of supplying air, including hot air, to the garment bag 18 are illustrated. For example, as shown in FIG. 15, in an embodiment, the fan 40 and heating element 38 and associated tubing (collectively, the air delivery system) may be housed in the base 12, similar to the embodiment disclosed above in connection with FIGS. 1-3. As shown in FIG. 16, in another embodiment, the air delivery system, including the heating element 38 and fan 40 may be integrated with the garment bag 18 (such as in a rigid or semi-rigid base portion 64 of the garment bag 18). In this manner, the garment bag 18 may be configured as a standalone system capable of delivering air/hot air to the interior of the bag for drying contents of the bag, and for use as an air cushion ironing board (in an inflated state). The bag 18 could then be retrofit onto, or used in combination with, a standard handheld or upright garment steamer to provide drying, steaming and ironing functions. FIG. 17 illustrates such a garment bag connected to the base 12 of a garment steamer.

Figure 18:
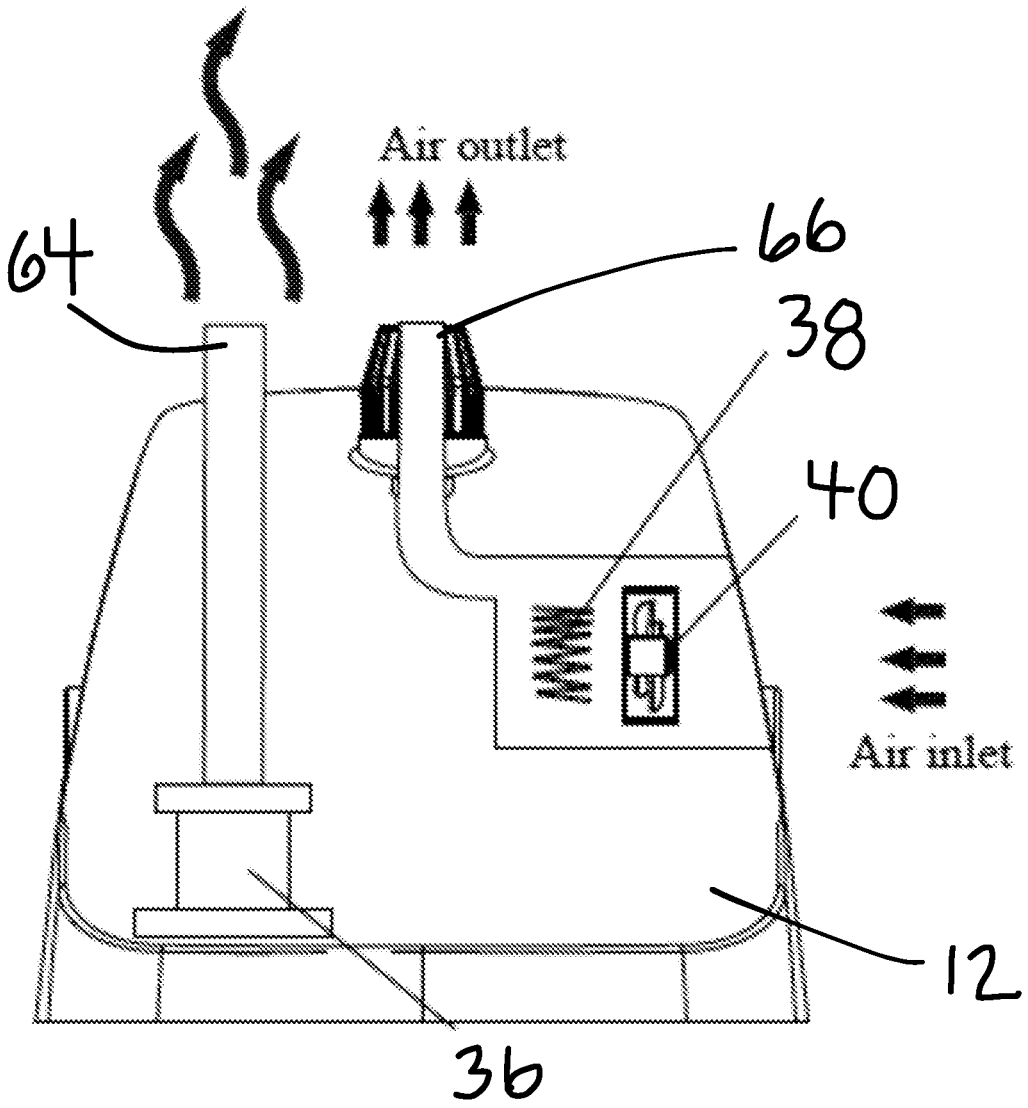
FIG. 18 is a schematic illustration of a steam and air flow path for a garment steaming device according to one embodiment of the present invention.
Figure 19:
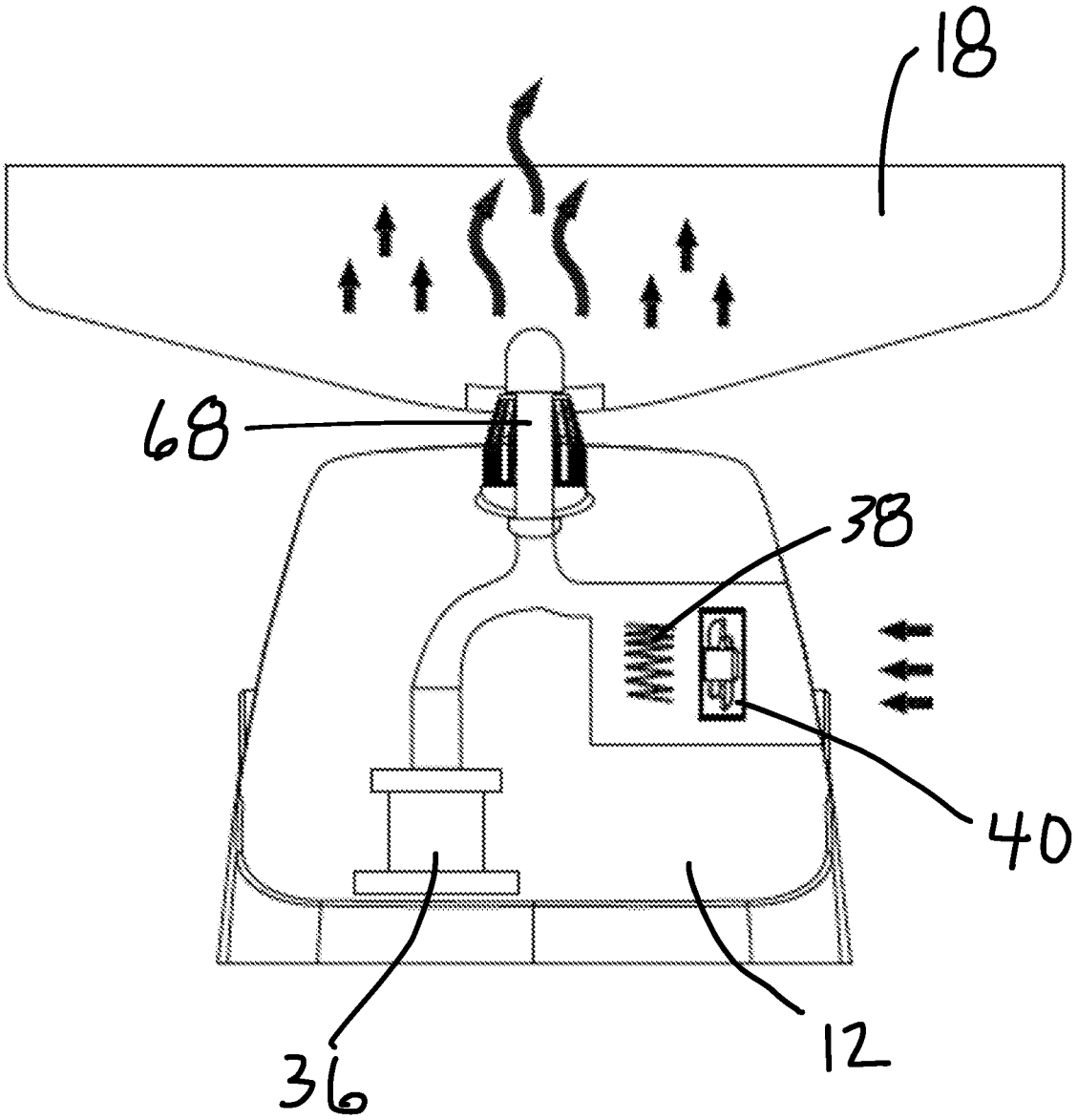
FIG. 19 is a schematic illustration of a steam and air flow path for a garment steaming device according to another embodiment of the present invention.

Turning to FIGS. 18 and 19, two alternative configurations of the steam and air delivery systems of the garment treatment device 10 are illustrated. As shown in FIG. 18, in an embodiment, the steam generator 36 and air delivery system (i.e., the fan 40 and heating element 38) may each include dedicated outlets 64, 66 for delivering steam and air, respectively, to the bottom of the garment bag 18. As illustrated in FIG. 19, the steam generator 36 and air delivery system may, instead, share a common outlet 68 for delivering steam and air to the bottom of the garment bag 18. In either implementation, during the steam refresh mode of operation, condensate may form accumulate at the bottom of the garment bag 18. The air delivery system, however, may help dry and eliminate such condensate.

Figure 20:
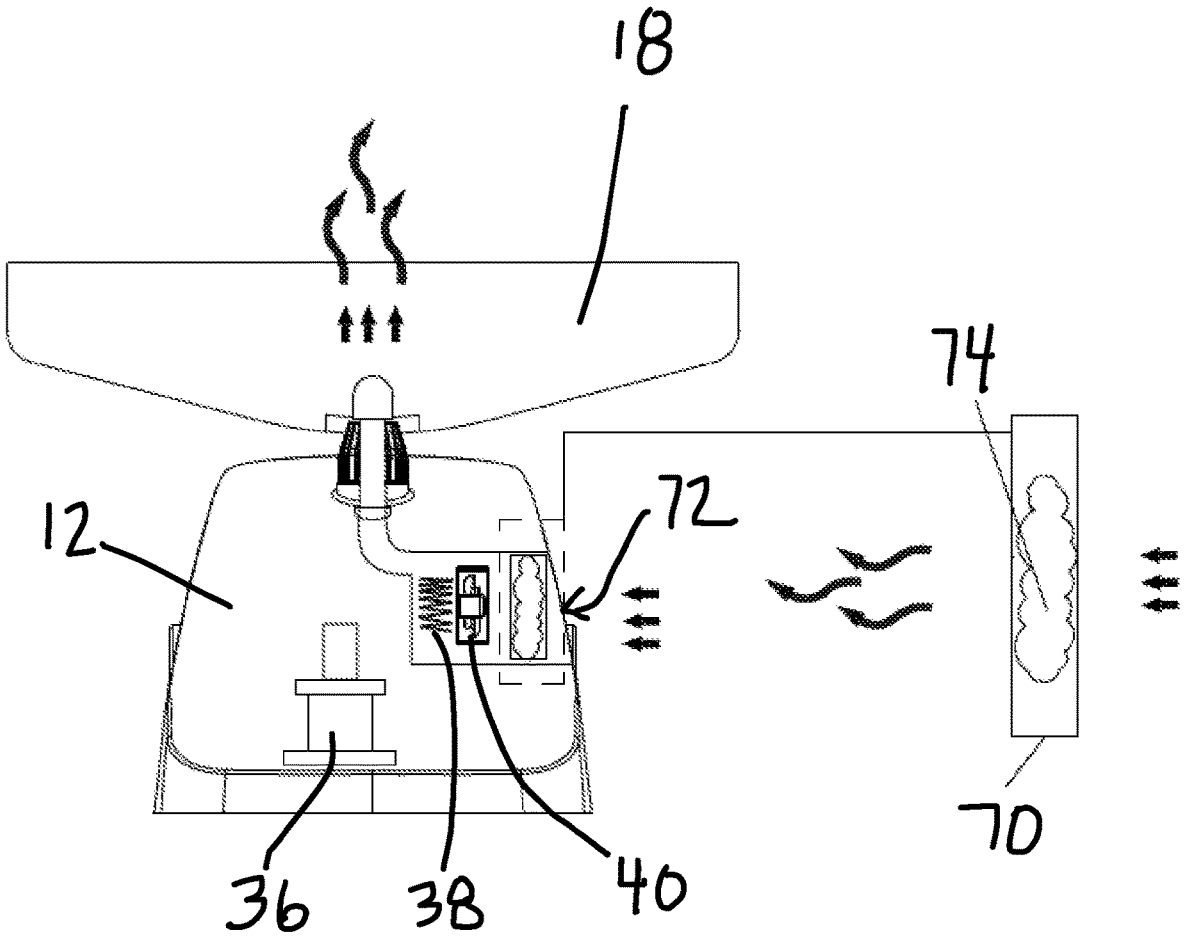
FIG. 20 is a schematic illustration of a portion of a garment steaming device having an aroma attachment, according to an embodiment of the present invention.

As shown in FIG. 20, in an embodiment, an aroma cartridge 70 may be received in the air intake opening 72 of the base 12. The aroma cartridge may house an aroma capsule 74, material or the like so that when air is drawn in by the fan 40, it passes through the cartridge 70 thereby adding a fragrance to the air. During the air drying mode of operation, the scented/fragranced air will be passed into the garment bag 18, enriching the garment with the aroma/fragrance from the cartridge 70.

Figures 21, 22, 23:
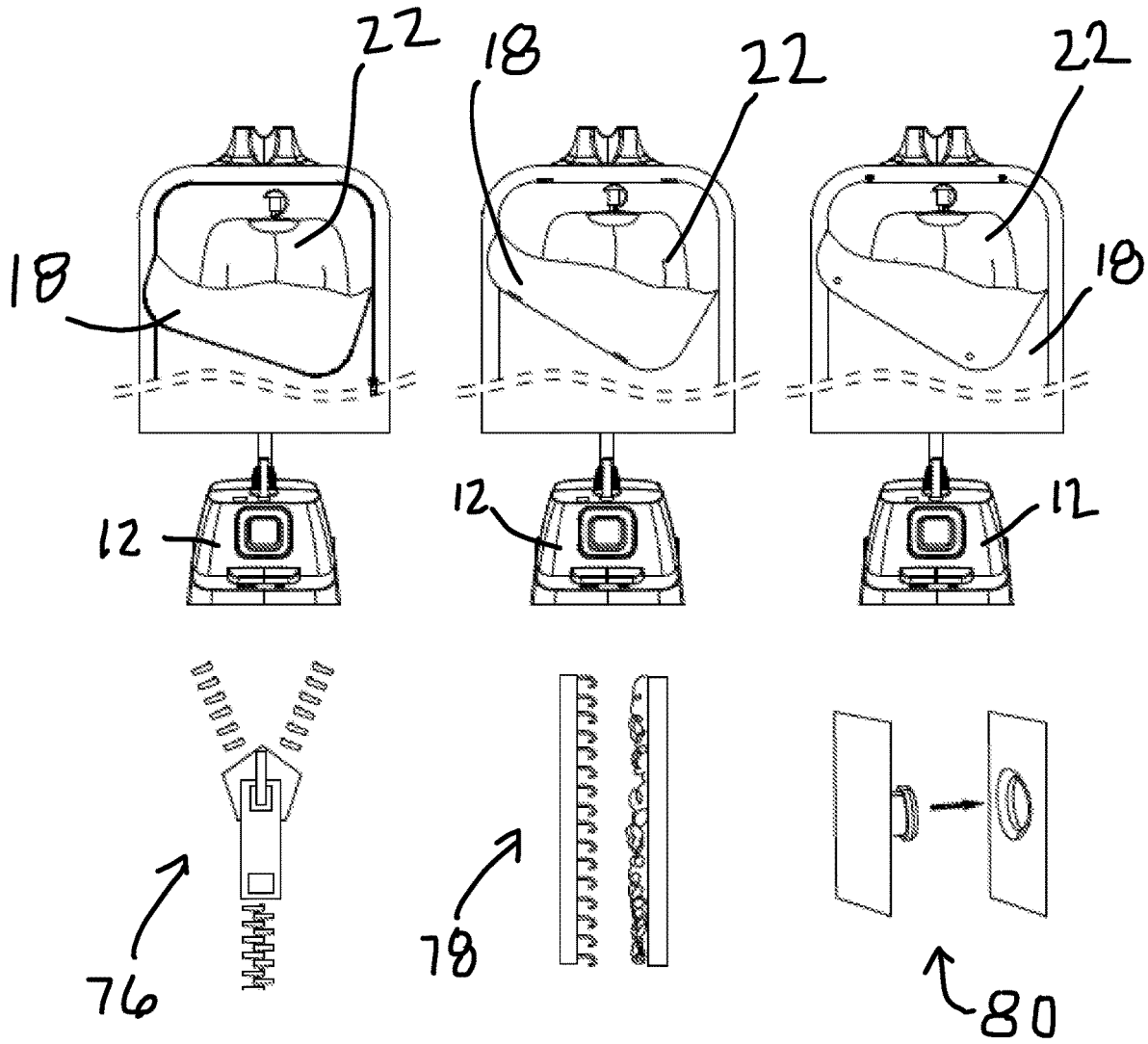
FIG. 21 illustrates an opening/sealing configuration for a bag of a garment steaming device according to an embodiment of the present invention.
FIG. 22 illustrates an opening/sealing configuration for a bag of a garment steaming device according to another embodiment of the present invention.
FIG. 23 illustrates an opening/sealing configuration for a bag of a garment steaming device according to another embodiment of the present invention.

Turning now to FIGS. 21-23, various garment bag closure mechanisms/types are illustrated. As shown in FIG. 21, for example, the garment bag 18 may be opened and closed via a zipper closure mechanism 76. As shown in FIG. 22, the garment bag 18 may, alternatively, be opened and closed via a magic tape, Velcro or similar interlocking structure closure mechanism 78. In yet another embodiment, a button closure mechanism 80 may be employed, as shown in FIG. 23.

As disclosed above, the present invention therefore provides a multifunction garment treatment device that is capable of drying garments or articles of clothing or other fabric, steaming such items to remove wrinkles, and/or allowing for such items to be ironed and/or steam ironed using the garment bag as a vertical ironing board. In this respect, the garment treatment device 10 allows for one or more treatment techniques to be applied to garments using a single, compact device. As alluded to above, the base 12 of the device 12 may include a user interface, e.g., an array of buttons, knobs and/or switches that allow a user to select the various modes of operation of the device, i.e., steam refresh, hot air (for drying), ironing, etc.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A garment treatment device, comprising:

a flexible garment bag having an interior space sized to receive a garment; and an air delivery system configured to provide air to the interior space to dry the garment in a drying mode of operation, and to inflate the garment bag so that an exterior, front face of the garment bag forms a cushioned support surface configured for supporting the garment in an ironing mode of operation.

2. The garment treatment device of claim 1, wherein:

the air delivery system includes a heating element for heating the air and a fan for providing the air to the interior space.

3. The garment treatment device of claim 2, further comprising:

a base;

a fluid reservoir received on the base;

a steam generator housed in the base and in fluid communication with the fluid reservoir; and a pole extending from the base, the pole being configured to support the garment bag;

wherein the steam generator is configured to convert fluid from the fluid reservoir into steam for passage into the flexible garment bag in a steaming mode of operation.

4. The garment treatment device of claim 3, wherein:

the heating element and the fan are housed in the base.

5. The garment treatment device of claim 3, further comprising:

a handheld steam nozzle connected to the base, the handheld steam nozzle being configured to receive steam from the steam generator in a handheld steaming and/or ironing mode of operation.

6. The garment treatment device of claim 4, further comprising:

an aroma cartridge receivable within an air inlet opening in the base, the aroma cartridge being configured to receive a fragrance material;

wherein the fan is configured to draw the air through the air inlet opening and past the fragrance material to impart a fragrance to the air provided to the interior space.

7. The garment treatment device of claim 3, further comprising:

a handheld steam nozzle connected to the base, the handheld steam nozzle being configured to receive fluid from the fluid reservoir and to convert the fluid into steam in a handheld steaming and/or ironing mode of operation.

8. The garment treatment device of claim 3, wherein:

the pole includes a hanger for hanging the garment, and a cradle for receiving and supporting a handheld steam nozzle.

9. The garment treatment device of claim 2, wherein:

the fan and the heating element are integrated into the flexible bag.

10. The garment treatment device of claim 2, wherein:

the garment bag includes a plurality of apertures allowing for release of the air and/or the steam from the garment bag.

11. The garment treatment device of claim 2, wherein:

at least a subset of the plurality of apertures are located in the front face of the garment bag so as to direct the steam onto the garment when the garment is supported on the exterior front face of the garment bag.

12. The garment treatment device of claim 1, wherein:

the flexible bag includes a closure mechanism that can be selectively opened to access the interior space;

wherein the closure mechanism is one of a zipper closure mechanism, a button closure mechanism or an interlocking mechanism.

13. A garment treatment device, comprising:

a base;

a water reservoir received on the base;

a steam generator housed in the base and in fluid communication with the water reservoir;

an air delivery system housed in the base;

a pole extending from the base; and a garment bag having an interior space sized to receive a garment, the garment bag being receivable on the pole;

wherein the air delivery system is configured to provide air to the interior space to dry the garment in a drying mode of operation, and to inflate the garment bag so that an exterior, front face of the garment bag forms a cushioned support surface configured for supporting the garment on the exterior, front face in an ironing mode of operation; and wherein the steam generator is configured to convert water from the water reservoir into steam for passage into the garment bag in a steaming mode of operation.

14. The garment treatment device of claim 13, wherein:

the air delivery system includes a heating element for heating the air and a fan for providing the air to the interior space.

15. The garment treatment device of claim 14, further comprising:

a handheld steam nozzle connected to the base, the handheld steam nozzle being configured to receive steam from the steam generator;

wherein the handheld steam nozzle is manipulated to direct the steam onto the garment supported by the exterior, front face of the garment bag in the ironing mode of operation.

16. The garment treatment device of claim 15, wherein:

the garment bag includes a plurality of apertures allowing for release of air and/or steam from the garment bag;

wherein at least a subset of the plurality of apertures are located in the front face of the garment bag so as to direct the steam onto the garment when the garment is supported on the exterior, front face of the garment bag in the ironing mode of operation.

17. The garment treatment device of claim 16, further comprising:

a fragrance cartridge receivable within an air inlet opening in the base, the fragrance cartridge being configured to receive a fragrance material;

wherein the fan is configured to draw the air through the air inlet opening and past the fragrance material to impart a fragrance to the air provided to the interior space.

18. The garment treatment device of claim 14, further comprising:

a handheld steam nozzle fluidly connected to the base, the handheld steam nozzle being configured to receive water from the water reservoir and to convert the water into steam;

wherein the handheld steam nozzle is manipulated to direct the steam onto the garment supported by the exterior, front face of the garment bag in the ironing mode of operation.

19. The garment treatment device of claim 13, wherein:

the pole includes a hanger for hanging the garment, and a cradle for receiving and supporting a handheld steam nozzle.

20. The garment treatment device of claim 13, wherein:

the pole is rotatable with respect to the base.

* * * * *